US006595515B2

(12) United States Patent
Numata et al.

(10) Patent No.: US 6,595,515 B2
(45) Date of Patent: Jul. 22, 2003

(54) SHEET CONVEYING DEVICE WITH INCREASED ELECTRIC VOLTAGE

(75) Inventors: Yasuhiro Numata, Kawasaki (JP); Osamu Kanome, Yokohama (JP); Noriyuki Chino, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 38 days.

(21) Appl. No.: 09/925,471

(22) Filed: Aug. 10, 2001

(65) Prior Publication Data

US 2002/0024576 A1 Feb. 28, 2002

(30) Foreign Application Priority Data

Aug. 11, 2000 (JP) ..... 2000-243760
Jan. 10, 2001 (JP) ..... 2001-002231

(51) Int. Cl.[7] ..... B65H 5/02

(52) U.S. Cl. ..... 271/193; 271/275; 271/18.1; 198/691

(58) Field of Search ..... 271/193, 275, 271/18.1; 198/691

(56) References Cited

U.S. PATENT DOCUMENTS 3,584,733 A * 6/1971 Isermann ..... 198/691
3,690,646 A * 9/1972 Kolibas ..... 198/691
5,270,738 A * 12/1993 Takahashi et al. ..... 347/24
5,280,308 A * 1/1994 Takahashi et al. ..... 346/134
5,300,984 A * 4/1994 Fuma et al. ..... 399/66
5,531,436 A * 7/1996 Ohyama et al. ..... 271/275
5,568,244 A * 10/1996 Hirai et al. ..... 399/382
6,092,800 A * 7/2000 Compera et al. ..... 271/193
6,267,225 B1 * 7/2001 Compera et al. ..... 198/691

FOREIGN PATENT DOCUMENTS

JP 11-147359 * 6/1999

* cited by examiner

*Primary Examiner*—Patrick H. Mackey
(74) *Attorney, Agent, or Firm*—Fitzpatrick, Cella, Harper & Scinto

(57) ABSTRACT

The present invention relates to a sheet conveying device for attracting a sheet by electric power and for conveying the sheet, the sheet conveying device comprising a belt arranged with an electrode and a plurality of electric supplying members being aligned in a sheet conveying direction for supplying electric voltage to the electrode. An electric voltage value for an electric supplying members arranged at a primary area upstream in a sheet conveying direction is lower than an electric voltage value for an electric supplying members arranged at a secondary area downstream of the primary area in a sheet conveying direction.

21 Claims, 19 Drawing Sheets

SHEET CONVEYING DEVICE WITH INCREASED ELECTRIC VOLTAGE

BACKGROUND OF THE INVENTION

1. Field of the Invention

This invention relates to a conveying device for conveying a sheet and a recording apparatus for recording an image recorded upon a sheet conveyed by the conveying device.

2. Description of Related Art

Conventionally, as for a recording apparatus of this type, there is a recording apparatus such as an inkjet type printer. Among such type, there is a type using a full line type recording head having plural discharge ports arranged in a sheet-width direction, in which high speed and high grade recording is possible.

Accordingly, a commonly known conveying method is a method of arranging a conductive electrode to a conveying device for such recording apparatus, generating a static electricity by supplying electric voltage, and enabling attraction (absorption) of a conveying article such as a sheet.

FIG. 18 is a schematic structural view of a conventional conveying device and recording apparatus, and FIG. 19 is a schematic cross-sectional view of an attraction means (also illustrates electric supplying means).

An attraction means 536 is arranged to a conveyor belt 531. The attraction means 536 is comprised of an electrode plate 536*a* made from a conductive metal, a base layer 536*c*, a surface layer 536*b*, a targeted electric supply portion 536*e*, in which the surface layer 536*d* and the targeted electric supply portion 536*e* are in a flat state.

Electric voltage is supplied to the electrode plate 536*a* from the electric supplying brush 551 contacting with a targeted electric supply portion for generating electrostatic power. Owing to the generated electrostatic power, a constant suitable attraction strength is generated upon a conveyed article such as a sheet. Further, the electric power applied from electric supplying brush 551 is removed by an electric removal brush 539.

Nevertheless, with the conventional structure as shown in FIG. 18, when the electric supplying brush of the electric supplying means serving to supply high electric voltage makes contact with the targeted electric supply portion 536*e* of the conveyor belt or when the electric removal brush 539 makes contact with the targeted electric supply portion, noise would be created from the large electric potential difference.

Further, as explained above, since the electric supplying brush 551 is suddenly applied with high voltage when making contact with the electric supply portion 536*e*, the electric supplying brush 551 receives shock when such making contact (when supplying electricity), which raises a problem of endurance when used for a long period; further, since the electric removal brush 539 is suddenly short-circuited when making contact with the electric supply portion 536*e*, the electric removal brush 539 receives shock when making such contact (when removing electric power), which raises a problem of endurance when used for a long period.

Therefore, it is an object of this invention to reduce noise created when supplying electricity, to reduce shock when supplying electricity or when removing electric power, and to heighten the endurance of an electric supplying brush and an electric removal brush.

SUMMARY OF THE INVENTION

In means to achieve the foregoing object, this invention provides a sheet conveying device for attracting (absorbing) a sheet by electric power and conveying the sheet, the sheet conveying device comprising: a belt arranged with an electrode; and a plurality of electric supplying means being aligned in a sheet conveying direction for supplying electric voltage to the electrode, wherein an electric voltage value for an electric supplying means arranged at a primary area upstream in a sheet conveying direction is lower than an electric voltage value for an electric supplying means arranged at a secondary area downstream of the primary area in a sheet conveying direction.

According to the embodiment described afterwards, when an electric supplying means supplies electric voltage to an electrode, a low voltage is supplied first, and then a higher voltage is supplied; accordingly, compared to a case where a high voltage is suddenly supplied, the shock when making contact could be reduced and a creation of noise and the deterioration of a electric supplying brush could be restrained.

Further, this invention provides a sheet conveying device for attracting (absorbing) a sheet by electric power and conveying the sheet, the sheet conveying device comprising: a belt arranged with an electrode; and a plurality of electric supplying means being aligned in a sheet conveying direction for supplying electric voltage to the electrode, wherein an electric supply control means is provided for changing the electric voltage value of the plurality of electric supplying means.

Since an electric supply control means for changing the electric voltage value of an electric supplying means is provided, attraction strength most suitable for conveying a sheet could be generated by changing the electric voltage value of an electric supplying means in accordance with environmental conditions such as humidity or conditions such as the characteristic of a sheet.

Another structure of this invention for achieving the aforementioned object is a sheet conveying device supplying electric voltage to a non-end belt member while rotating the belt member, and conveying a sheet by attracting the sheet to a surface of the belt member, the sheet conveying device comprising: an electric supplying means being capable of supplying electric voltage to a belt member having a targeted electric supply portion, and having a plurality of electric supplying members aligned in a conveying direction; and a control means for controlling the electric voltage value of electric voltage supplied from the plurality of electric supplying members of the electric supplying means to the targeted electric supply portion of the belt member, wherein an electric supplying member of the electric supplying means being most upstream in a conveying direction gradually raises the electric voltage from a secondary electric voltage value being smaller than a primary electric voltage value for allowing attraction of a sheet upon the belt member after making contact to a targeted electric supply portion of the belt member, and raises the electric voltage to the primary electric voltage value until separated from the targeted electric supply portion.

With this invention, the electric supplying means having plural electric supplying members aligned in the conveying direction serves to reduce shock during contact compared to a case of suddenly applying high voltage so as to heighten the endurance for an electric supplying member, in which an electric supplying member at a non-recording area positioned upstream of a recording area gradually raises electric voltage from a secondary electric voltage value being smaller than that of the primary electric voltage value for allowing a sheet to be attracted (absorbed) upon a belt member after making contact with a targeted electric supply portion of the belt member, and the electric voltage is raised to the primary electric voltage value until being separated from the targeted electric supply portion. Accordingly, the noise caused by the conveyor belt could be exceedingly reduced to allow the device to operate steadily.

As for another structure of this invention, a sheet conveying device supplying electric voltage to a non-end belt member while rotating the belt member, and conveying a sheet by attracting the sheet to a surface of the belt member, the sheet conveying device comprising: an electric supplying means being capable of supplying electric voltage to a belt member having a targeted electric supply portion, and having a plurality of electric supplying members aligned in a conveying direction; and a control means for controlling the electric voltage value of electric voltage supplied from the plurality of electric supplying members of the electric supplying means to the targeted electric supply portion of the bolt member, wherein an electric supplying member of the electric supplying means being most downstream in a conveying direction gradually lowers the electric voltage from a primary electric voltage value for allowing attraction (absorption) of a sheet upon the belt member after making contact to a targeted electric supply portion of the belt member, and lowers the electric voltage to a secondary electric voltage value being smaller than the primary electric voltage value until separated from the targeted electric supply portion.

With this invention, the electric supplying means serves to allow reduction of shock during removal of electricity compared to the shock of suddenly short-circuiting and results to heighten the endurance for an electric supplying member, in which an electric supplying member at a non-recording area positioned downstream of a recording area gradually lowers electric voltage from a primary electric voltage value for allowing a recording medium to be attracted upon a belt member after making contact with a targeted electric supply portion of the belt member, and the electric voltage is lowered to the secondary electric voltage value being smaller than the primary electric voltage value until being separated from the targeted electric supply portion. Accordingly, the noise caused by the conveyor belt could be exceedingly reduced to allow the device to operate steadily.

BRIEF DESCRIPTION OF THE DRAWINGS

The above and other objects and features of the invention are apparent to those skilled in the art from the following preferred embodiments thereof when considered in conjunction with the accompanied drawings, in which.

DESCRIPTION OF THE PREFERRED EMBODIMENTS

Embodiments of this invention will hereinafter be described in detail with reference to the following drawings. Nevertheless, unless specified in particular, the descriptions in the embodiments for the comprising components such as measurement, material, shape, and relative arrangement are not intended to limit the scope of this invention.

First Embodiment

A first embodiment of the conveying device and recording apparatus will hereinafter be described with reference to FIG. 1 through FIG. 8.

First, an electric supplying means being the most characteristic feature of this embodiment will be described with reference to FIG. 1 through FIG. 3.

Figure 1:
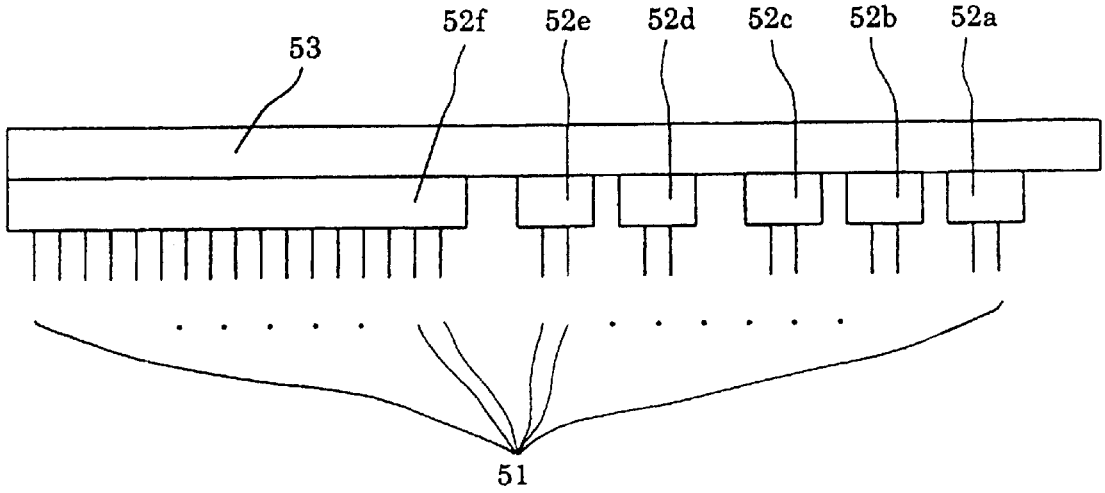
FIG. 1 is a schematic structural view showing an electric supplying means for the first embodiment of this invention.

FIG. 1 is a schematic structural view showing an electric supplying means of this embodiment.

Numeral 51 is an electric supplying brush, numeral 52 is an electric supplying electrode, and numeral 53 is a supporting member, in which electric supplying electrode 52 of this embodiment is comprised of six electric supplying electrodes 52*a* through 52*f*.

Figure 2:
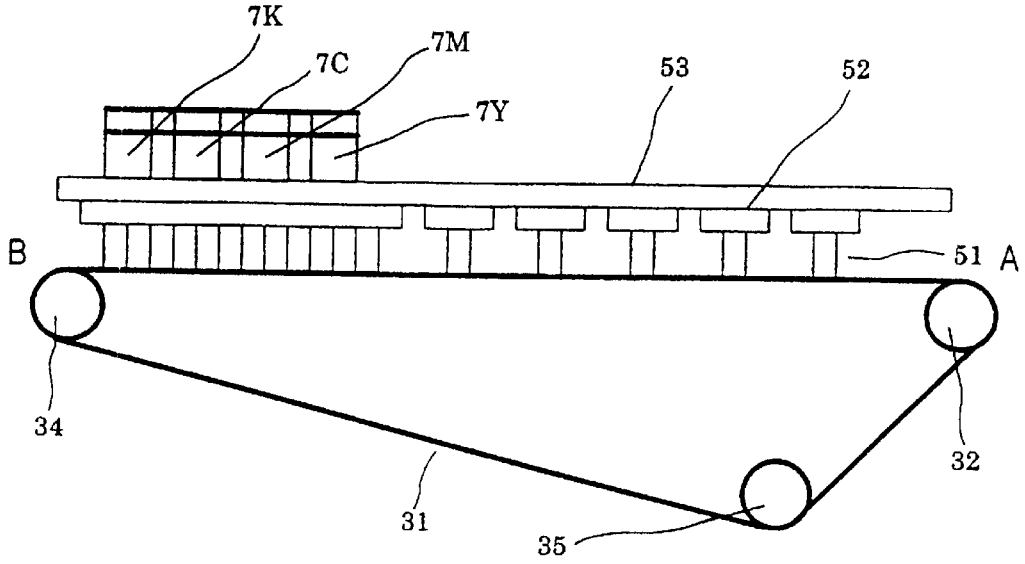
FIG. 2 is a schematic structural view of a conveying means and a recording means for the first embodiment of this invention.

FIG. 2 is a schematic structural view of a conveying means and a recording means of this embodiment.

The letter A is the sheet feeding side, and the letter B is the sheet discharging side, in which movement of a conveyor belt 31 allows a sheet to be conveyed from the sheet feeding side A to the sheet discharging side B.

The conveyor belt 31 is arranged with a targeted electric supply portion, in which the targeted electric supply portion contacts with the electric supplying brush 51 so as to supply electric voltage during rotation of the conveyor belt 31.

The length of the electric supplying electrodes 52*a* through 52*f* of this embodiment are different in a conveying direction, in which the length of the electric supplying electrodes 52*a* through 52*e* are 3 cm, and the length of the electric supplying electrode 52*f* is 20 cm; each of the electric supplying electrodes are arranged upon the supporting members in a 3 cm interval. The length of the targeted electric supply portion is 2 cm in the conveying direction.

Such arrangement is a necessary requirement to prevent two or more electric supplying brushes 51 from supplying electric voltage to a single targeted electric supply portion.

The electric voltage for electric supplying electrodes 52*a* through 52*f* is respectively different, in which, the voltage for electric supplying electrode 52*a* is 0.5 kV, the voltage for the electric supplying electrode 52*b* is 1.0 kV, the voltage for the electric supplying electrode is 1.5 kV, the voltage for the electric supplying electrode 52*d* is 2.0 kV, the voltage for the electric supplying electrode 52*e* is 2.5 kV, and the voltage for the electric supplying electrode 52*f* is 3.0 kV.

Figure 3:
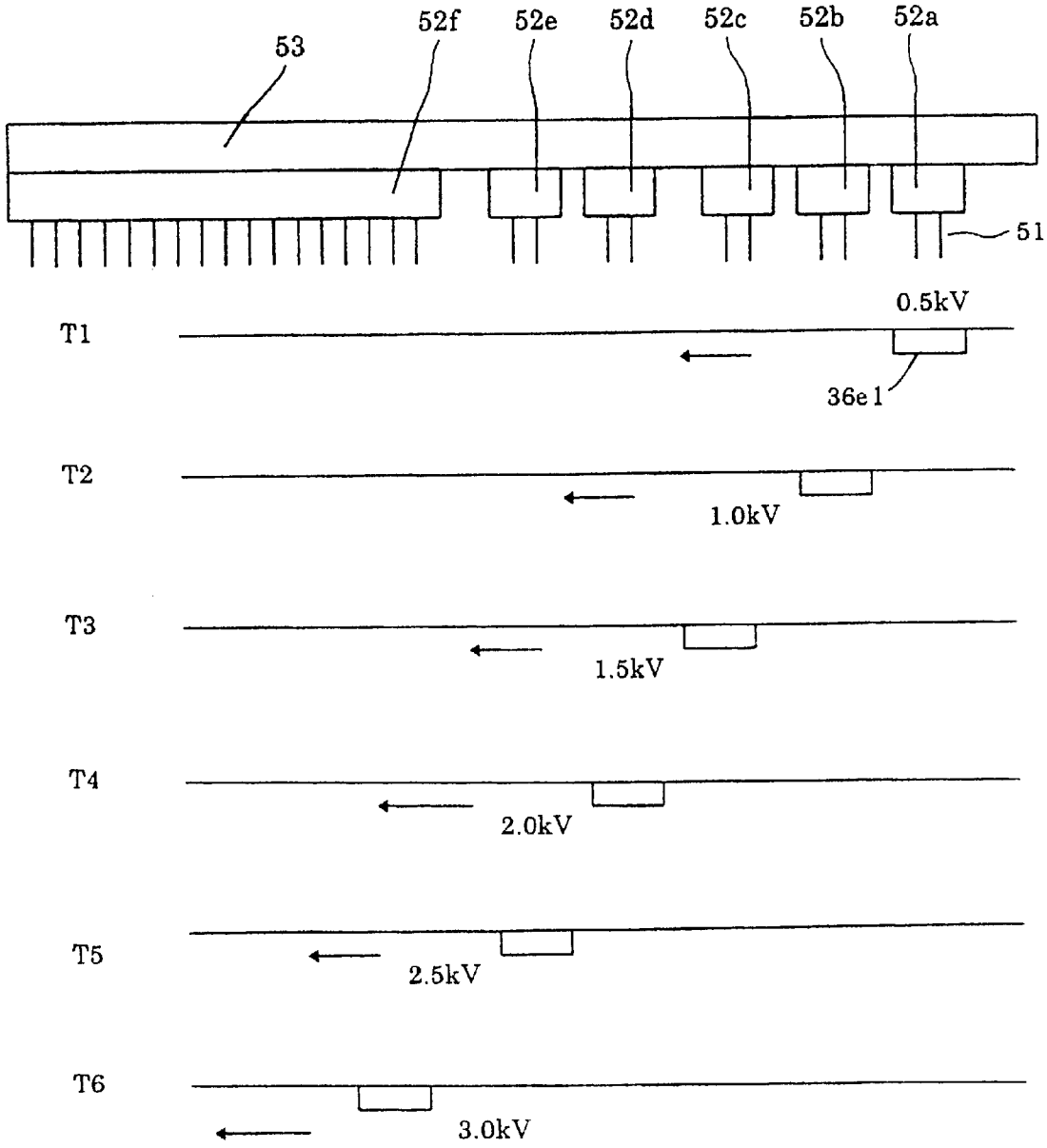
FIG. 3 is an explanatory view for explaining the change of electric voltage of the targeted electric supply portion for the first embodiment of this invention.

FIG. 3 is an explanatory view for explaining the change of electric voltage of the targeted electric supply portion, in which the change in the electric voltage of the targeted electric supply portion is shown in accordance with the movement of the conveyor belt.

At a point in time of time T1, an electric voltage of 0.5 kV of the electric supplying electrode 52*a* is supplied to a targeted electric supply portion 36*e*1 from the electric supplying brush 51, which results to a voltage of 0.5 kV for the targeted electric supply portion 36*e*1.

In the same manner, at a point in time of time T2, ail electric voltage of 1.0 kV of the electric supplying electrode 52*b*; at a point in time of time T3, an electric voltage of 1.5 kV of the electric supplying electrode 52*c*; at a point in time of time T4, an electric voltage of 2.0 kV of the electric supplying electrode 52*d*; at a point in time of time T5, an electric voltage of 2.5 kV of the electric supplying electrode 52*e*; and at a point in time of time T6, an electric voltage of 3.0 kV of the electric supplying electrode 52*f* is supplied to a targeted electric supply portion 36*e*1 from the electric supplying brush 51, respectively.

Accordingly, in accordance with the movement of the conveyor belt 31, when the targeted electric supply portion 36*e*1 moves in a direction from the sheet feeding side A to the sheet discharging side B, the electric voltage of the targeted electric supply portion 36*e*1 gradually increases, and also the attraction (absorption) strength of the conveyor belt 31 gradually increases.

FIG.2 shows a positional relation between the conveyor belt 31, and recording heads 7Y, 7M, 7C, and 7K for the electric supplying means.

The recording head 7Y, 7M, 7C, and 7K are arranged at the electric supplying electrode 52*f*, which is the lowermost downstream position in the conveying direction; at such position, recording upon a conveyed sheet is performed by the recording heads, and such position is also an area where a powerful attraction strength is desired.

At a point in time where a conveyed sheet from the sheet feeding side A passes a position of electric supplying electrode 52*a*, the sheet is attracted to the conveyor belt 31 having an attraction strength equal to 0.5 kV. As the sheet passes the position of the electric supplying electrodes 52*b* through 52*f*, the attraction strength of the conveyor belt 31 increases; the sheet is attracted to the conveyor belt 31 having attraction strength equal to 3.0 kV by a point in time where the sheet passes a position of the recording head 7Y It is now to be noted that the width of the recording head 7Y, 7M, 7C, and 7K is 2 cm in the conveying direction, in which the recording heads 7Y, 7M, 7C and 7K are arranged having an interval of 3 cm.

The 20 cm length of electric supplying electrode 52*f* is a sufficient length for enabling electric supply starting from a beginning position of the recording head 7Y being uppermost upstream till reaching a tip-end portion of the recording head 7K being lowermost downstream.

Accordingly, during the supplying of electric voltage from the electric supplying electrodes 52*b* through 52*f* to the targeted electric supply portion of the conveyor belt 31, since low voltage is supplied at first, and high voltage is then gradually applied, the shock caused during contact could be reduced, and noise or deterioration of the electric supplying brush could be restrained in comparison with a case of suddenly supplying high voltage.

Next, a structure of an attraction means will be described with reference to FIG. 4 and FIG. 5.

Figure 4:
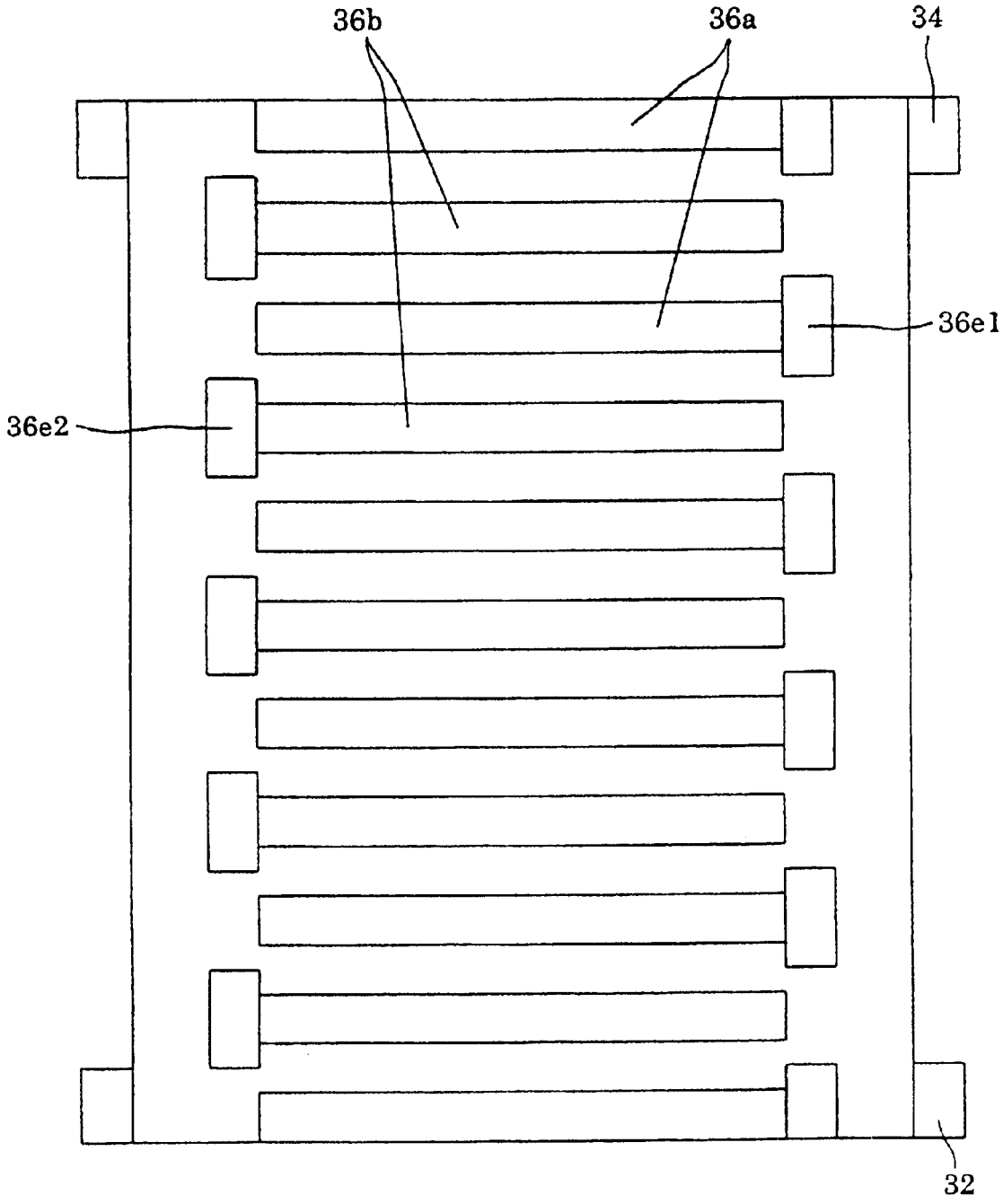
FIG. 4 is a schematic structural view of a conveyor belt and an attraction means for the first embodiment of this invention.

FIG. 4 is a schematic structural view of a conveyor belt and an attraction means when looking upon the conveyor belt 31 from directly above a main body of device.

Figure 5:
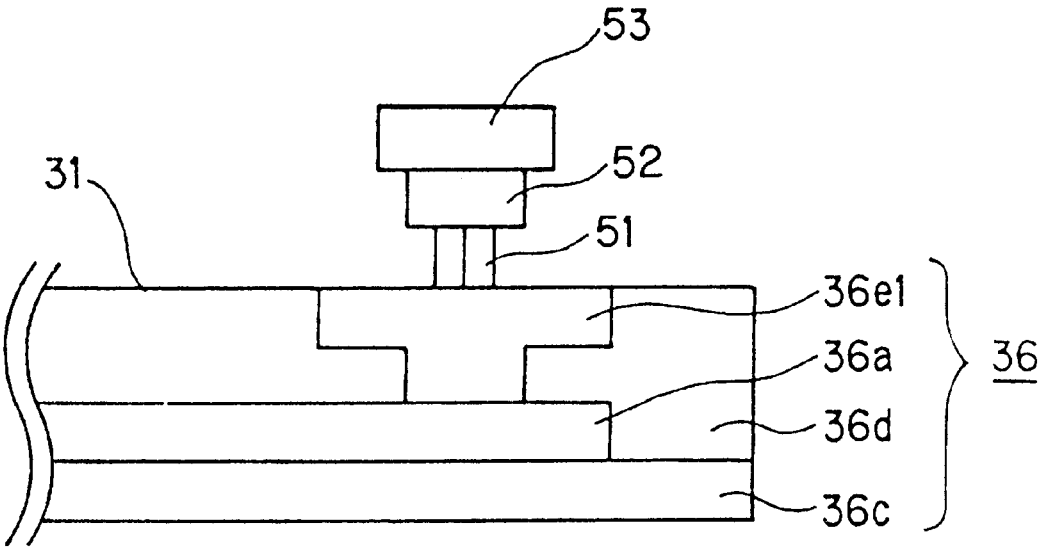
FIG. 5 is a schematic cross-sectional view of an attraction strength creating means for the first embodiment of this invention.

FIG. 5 is a schematic cross-sectional view of an attraction strength creating means for explaining electric supply from an electric supplying means to an electrode of a conveyor belt.

The attraction means 36 arranged at the conveyor belt 31 is comprised of an electrode plate 36*a* made from a conductive metal, a grounding electrode plate 36*b*, a base layer 36*c*, a surface layer 36*d*, and a targeted electric supply portion 36*e*1, 36*e*2, in which the targeted electric supply portion 36*e*1, 36*e*2 and the surface layer 36*d* are on the same plane, as shown in FIG. 5.

The electrode plate 36*a* and the grounding electrode plate 36*b* are plurally arranged in and out from a groove portion and a projecting portion, in a manner resembling to the teeth of a comb as shown in FIG. 4, in which the electrode plate 36*a* and the grounding electrode plate 36*b* are faced to each other in a direction perpendicularly intersecting to the belt conveying direction.

At both ends of the conveyor belt 31 in the conveying direction, the targeted electric supply portions 36*e*1, 36*e*2 are arranged having a longer width than that of the respective electrodes 36*a*, 36*b*, and also are arranged a conductive electric supplying brush 51 contacting to each of the targeted electric supply portions with a prescribed pressure Owing to the electric supplying brush 51, positive electric voltage is supplied from a high voltage power source (not shown) to the targeted electric supply portion 36*e*1. The targeted electric supply portion 36*e*2 is dropped to a grounding.

It is preferable to comprise the electric supplying brush 51 by using a conductive material with a volume resistivity of $10^{-6}$ through $10^{-7}$ Ωm.

The electrode plate 36*a* and the grounding electrode plate 36*b* are protected by being sandwiched by the base layer 36*c* and the surface layer 36*d* being made from dielectric material.

The volume resistivity for the base layer 36*c* is $10^{13}$ through $10^{15}$ Ωm and the volume resistivity for the surface layer 36*d* is $10^{8}$ through $10^{12}$ Ωm, in which both are comprised of synthetic material such as polyethylene or polycarbonate.

A side end portion of the electrode plate 36*a* is protected by being arranged in a manner sandwiched between the targeted electric supply portion 36*e*1 and the base layer 36*c*, and in the same manner, a side end portion of the electrode plate 36*b* is protected by being arranged in a manner sandwiched between the targeted electric supply portion 36*e*2 and the base layer 36*c*.

The targeted electric supply portions 36*e*1, 36*e*2 are comprised from a conductive synthetic resin with carbon inside having a volume resistivity of $10^{-6}$ through $10^{-7}$ Ωm.

The top surface of the surface layer 36*d* and the targeted electric supply portions 36*e*1, 36*e*2 are processed by means such as fluorine resin processing so as to create satisfactory water-repellency.

Figure 6:
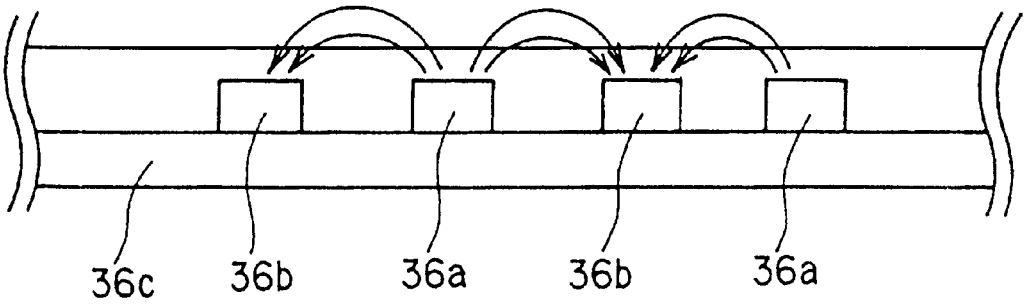
FIG. 6 is a schematic cross-sectional view of a conveyor belt for the first embodiment of this invention.

FIG. 6 is a schematic cross-sectional view of a conveyor belt for explaining the creation of attraction strength of the attraction means 36.

When electric voltage is applied to the electrode plate 36*a* from the electric supplying brush 51 contacting to the targeted electric supply portion 36*e*1 with a prescribed pressure, electric power is generated in an arrow direction shown in the drawing in which an electric power line is formed between the electrode plate 36*a* and the grounding electrode plate 36*b*.

Subsequently, owing to an electric potential difference between the electrode plate 36*a* and the grounding electrode plate 36*b*, attraction power is generated above the conveyor belt 31 and a sheet on the conveyor belt 31 is attracted.

In respect of this embodiment, since the base layer 36*c* is structured to have a greater volume resistivity than the surface layer 36*d*, the generated electric power line would be greater on a top Surface of the conveyor belt 31 for enabling the attraction strength at the top surface of the conveyor belt 31 to become larger.

Figure 7:
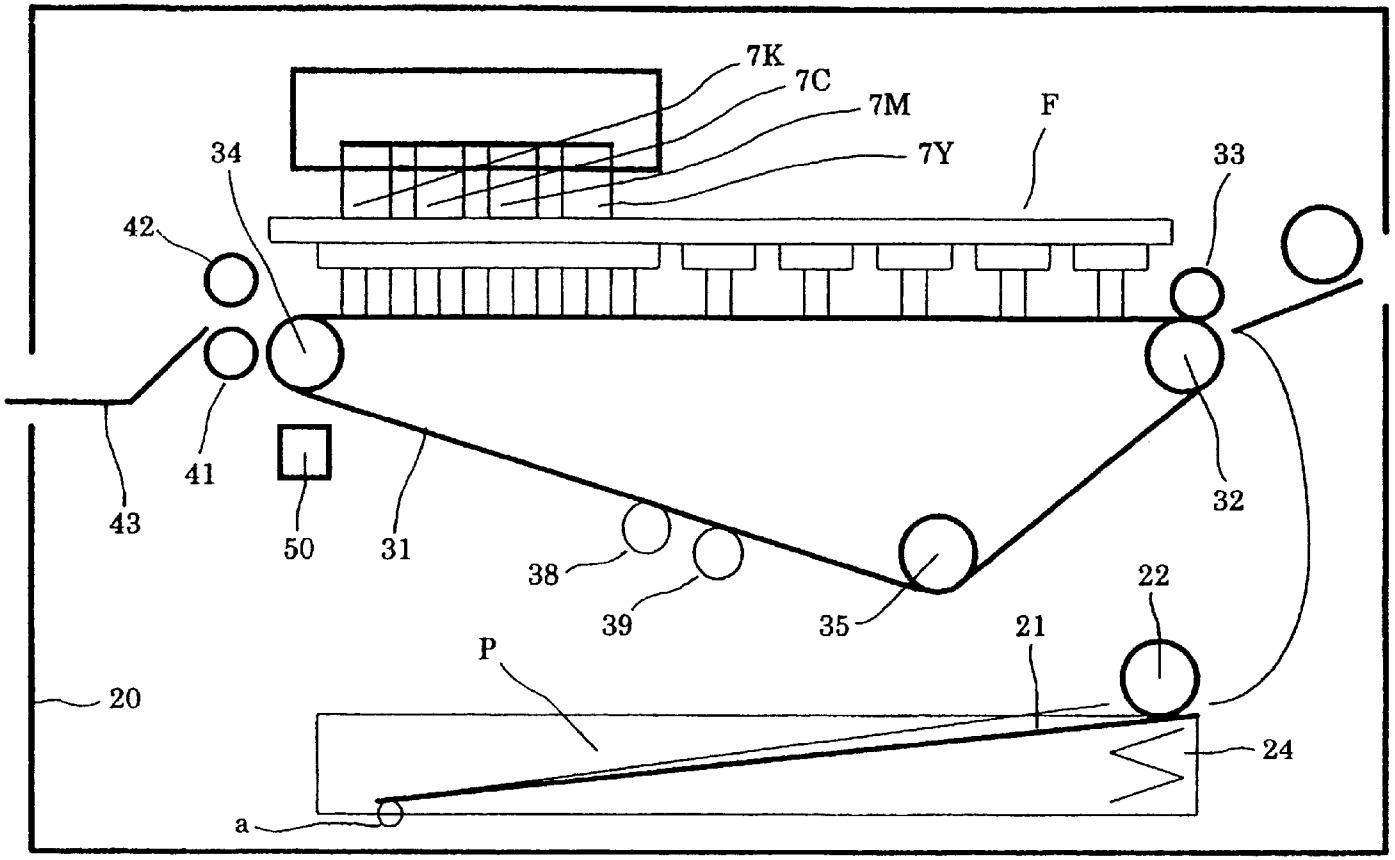
FIG. 7 is a schematic-structural view of a recording apparatus for the first embodiment of this invention.

Next, a recording apparatus for this embodiment will be described with reference to FIG. 7.

In thus drawing, the recording apparatus is comprised of a sheet feeding portion, a conveying portion, a recording head portion which is mounted on a carriage as a head mounting means, and a sheet discharging portion.

The sheet feeding portion has a pressure plate 21 for loading a recording sheet P, and a rotating feeding member 22 for feeding the recording sheet P. The pressure plate 21 is rotatively arranged with a rotation axis a serving as a center, and is urged upon the rotating feeding member 22 by a pressure plate spring 24. The rotating feeding member 22 is rotatively arranged with a rotation axis (not shown) .combined with a base 20, in which the rotation axis serves as a center.

The pressure plate 21 has a separation pad (not shown) made from a material having a large friction coefficient for preventing doubly feeding of the recording sheet P, and a separation claw for separating the recording sheet P. Further, a release cam (not shown) for releasing the contact between the pressure plate 21 and the rotating feeding member 22, Thus structured, the pressure plate 21 is pressed downward by the release cam when in a waiting state. Accordingly, the contact between the pressure plate 21 and the rotating feeding member 22 is released.

In such state, when a driving force of the conveying roller 32 is transmitted by a gear or the like to the rotating feeding member 22 and the release cam, the release cam is separated from the pressure plate 21, and the pressure plate 21 rises so that the rotating feeding member 22 and the recording sheet P would make contact.

Subsequently, in accordance with the rotation of the rotating feeding member 22, the recording sheet P is picked up to begin sheet feeding. The rotating feeding member 22 continues to rotate until the recording sheet is delivered to the conveying portion.

The conveying portion has a conveyor belt 31 for attracting and conveying the recording sheet P, and a PE sensor (not shown).

The conveyor belt 31 has an non-end belt shape, is driven by a driving roller 34, and is wrapped around a conveying roller 32 serving as subordinately moving roller, and around a pressure roller 35.

A belt motor 50 serves as a driving source for the driving roller 34, and the conveyor belt 31 moves at a speed of 170 mm per sec.

The conveyor belt 31 is made from a synthetic resin such as polyethylene.

A pinch roller 33 subordinately moving with the conveyor belt 31 is arranged at a position facing and contacting to the conveying roller 32, and serves to guide the recording sheet P being delivered from the sheet feeding portion to the conveying portion.

An electric supplying means F supplies 0.5 kV through 10 kV of electric voltage to the conveyor belt 31, and causes the recording sheet P to attract upon the conveyor belt.

The recording heads 7Y, 7M, 7C, and 7K are arranged downstream of the conveyor belt 31 in the conveying direction.

The recording heads 7Y, 7M, 7C, and 7K are recording heads of a full line inkjet type having several discharge ports arranged in a direction perpendicularly intersecting to the conveying direction, in which the resolution thereof is 600 dpi.

The recording heads 7Y, 7M, 7C, and 7K is capable of applying heat upon ink by a heater or the like. The ink is film boiled from such heat, and a growth or shrinkage of an air bubble created from the film boiling causes change in pressure so that ink could be discharged from the discharge port to form an image upon the recording sheet P.

The sheet discharging portion has a sheet discharging roller 41 and a spur 42. The recording sheet P having an image formed thereupon is sandwiched between the sheet discharging roller 41 and the spur 42, and is conveyed to and discharged from a sheet discharge tray 43.

Numeral 38 is a cleaning roller for cleaning the conveyor belt 31. Numeral 39 is an electric removal roller.

Figure 8:
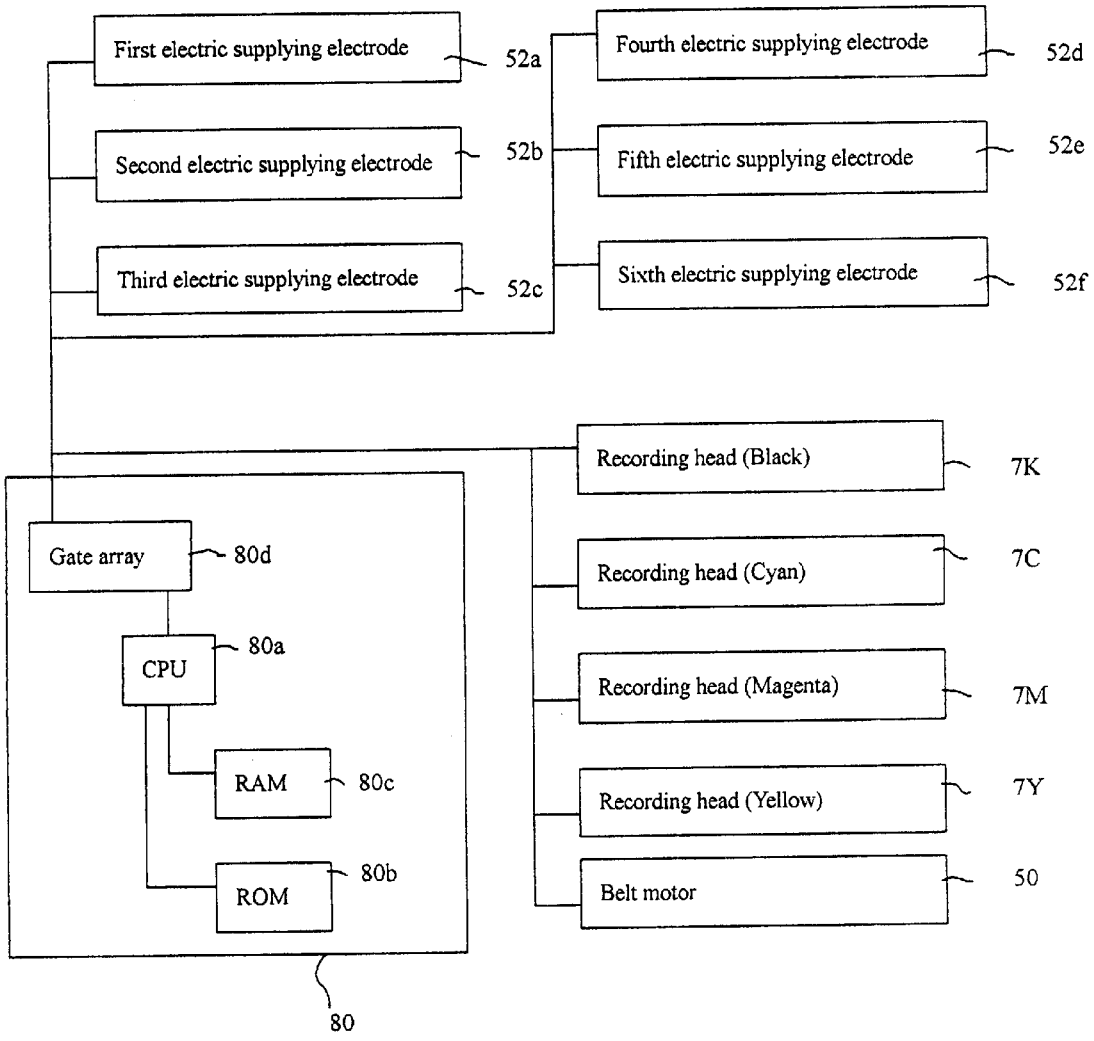
FIG. 8 is a block diagram regarding a control for a recording apparatus for the first embodiment of this invention.

FIG. 8 is a block diagram of a control for a recording apparatus regarding this embodiment.

Numeral 80 is a control section serving as a control means, which comprises a CPU 80*a* functioning in accordance with a control program, a ROM 80*b* being the memory for storing the control program, and a RAM 80*c* serving as the memory for operation and serving to save stain detection data or the like.

Along with the CPU 80*a*, a gate array 80*d* is an LSI serving to control a signal for the recording heads 7K, 7C, 7M and 7Y, or a signal (electric voltage) for the electric supplying electrodes 52*a* through 52*f*.

The control portion 80 is connected to the belt motor 50 being the driving source for rotating the conveyor belt 31, the recording head 7K for black, the recording head 7C for cyan, the recording head 7M for magenta, the recording head 7Y for yellow, the first electric supplying electrode 52*a*, the second electric supplying electrode 52*b*, the third electric supplying electrode 52*c*, the fourth electric supplying electrode 52*d*, the fifth electric supplying electrode 52*e*, and the sixth electric supplying electrode 52*f*.

Second Embodiment

In the first embodiment, a case where the electric supplying electrode 52*f* arranged at the position of recording having an electric voltage (hereinafter also referred as "electric supply for recording area") of 3 kV has been described; however, in the following second embodiment, the number of electric supplying electrodes and electric supply voltage for use are altered in correspondence with environmental conditions such as humidity or conditions such as the characteristics of a sheet.

Since other constitutions or functions are same to those explained in the first embodiment, the same composing portions would be assigned with the same reference numerals, while omitting the explanations thereof.

In this embodiment, there are two modes of attraction where one is a mode having "normal" attraction strength and the other is a mode having "strong" attraction strength; further, in correspondence with environmental conditions such as humidity or conditions such as the characteristics of a sheet, electric supply is controlled and attraction strength is altered. The control portion 80 explained above in the first embodiment serves as an electric supplying means.

When attraction strength is "normal", the electric supply voltage for the recording area is 2 kV; and each electric supplying electrode are set with an electric voltage of 0V for electric supplying electrodes 52*a* and 52*b*, 0.5 kV for electric supplying electrode 52*c*, 1.0 kV for electric supplying electrode 52*d*, 1.5 kV for electric supplying electrode 52*e*, and 2.0 kV for electric supplying electrode 52*f*.

When attraction strength is "strong", the electric supply voltage for the recording area is 3 kV, and each electric supplying electrode are set with an electric voltage of 0.5V for electric supplying electrodes 52*a*, 1.0 kV for electric supplying electrode 52*b*, 1.5 kV for electric supplying electrode 52*c*, 2.0 kV for electric supplying electrode 52*d*, 2.5 kV for electric supplying electrode 52*e*, and 3.0 kV for electric supplying electrode 52*f*.

Figure 9:
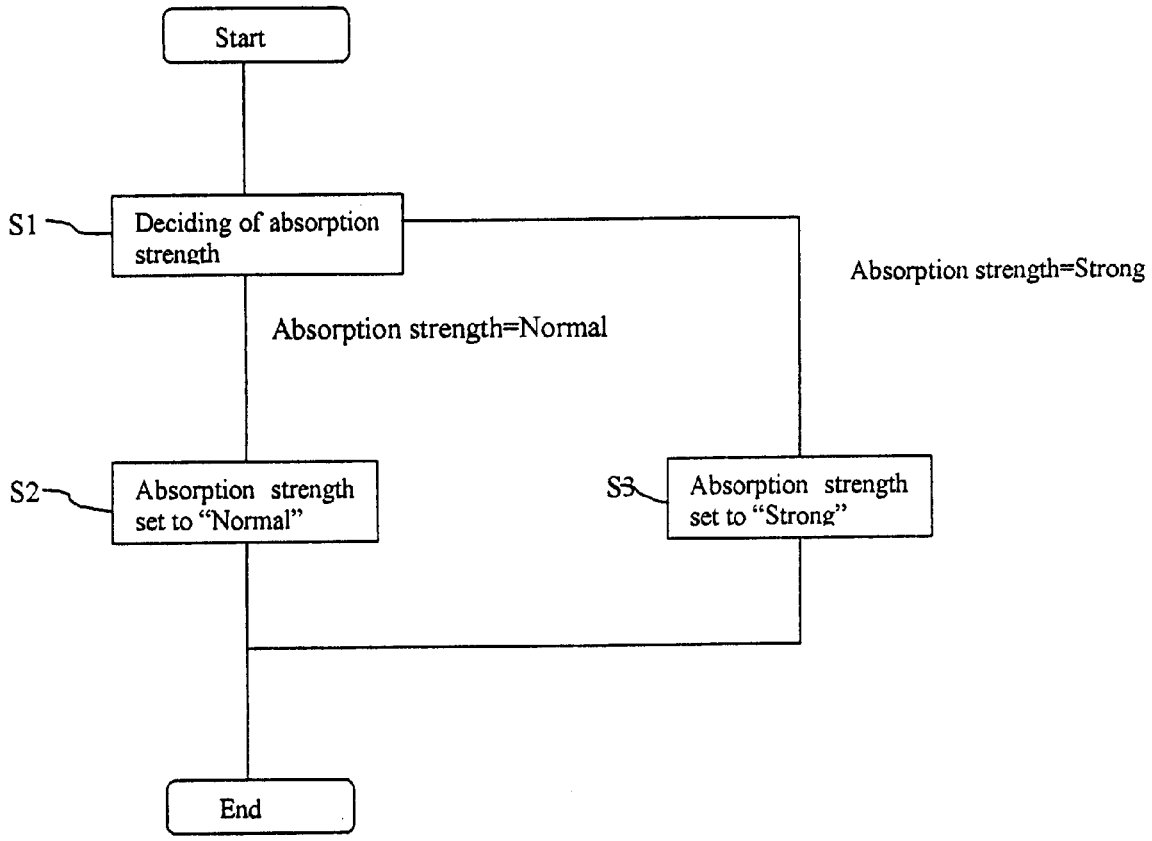
FIG. 9 is an explanatory view showing a flow regarding control for the second embodiment of this invention.

A flow of control regarding this embodiment will be explained with reference to FIG. 9.

In step S1, setting the attraction strength to either "normal" or "strong" is decided.

There is a divergence of flow in which S2 is a step when the attraction strength is set to "normal" and S3 is a step when the attraction strength is set to "strong".

In step S2, a process for generating "normal" attraction strength is performed. That is, each electric supplying electrode are set with an electric voltage of 0V for electric supplying electrodes 52*a* and 52*b*, 0.5 kV for electric supplying electrode 52*c*, 1.0 kV for electric supplying electrode 52*d*, 1.5 kV for electric supplying electrode 52*e*, and 2.0 kV for electric supplying electrode 52*f*, so that the electric supply voltage for the recording area would be 2 kV.

In step S3, a process for generating "strong" attraction strength is performed. That is, each electric supplying electrode are set with an electric voltage of 0.5V for electric supplying electrodes 52*a*, 1.0 kV for electric supplying electrode 52*b*, 1.5 kV for electric supplying electrode 52*c*, 2.0 kV for electric supplying electrode 52*d*, 2.5 kV f or electric supplying electrode 52*e*, and 3.0 kV for electric supplying electrode 52*f*, so that the electric supply voltage for the recording area would be 3 kV.

It is now to be noted that in step S1, the most suitable attraction strength for conveying a sheet is determined by anticipating the printing duty (the rate of the maximum amount of firable ink upon a certain area to the actual fired amount) for a recording sheet, or by using a hygrometer or the like.

For example, when the recording sheet for conveying is a plain paper having an average printing duty of 50 percent or more, the attraction strength is set to "strong". This due to the fact that a paper cockle would easily be caused by ink, and attraction to the conveyor belt would become difficult when a recording sheet of a high printing duty is used.

Further, even if a recording sheet of a low printing duty is used, depending on the environmental condition (e.g. a humidity of 60% or more) of the place where the recording apparatus is placed, it would be desirable to set the attraction strength to "strong" since the recording sheet bearing moisture would cause difficulty in attracting to the conveyor belt.

Although this embodiment is described having two modes of attraction, a electric supply control could also be performed having three or more modes of attraction depending on environmental conditions such as humidity or conditions such as the characteristics of a sheet.

Although a linear function is used as a voltage gradient between the electric supplying electrode 52*a* through the electric supplying electrode 52*f* in the embodiment above, a secondary function or other function could also be used as the voltage gradient, and further, the value of electric supply voltage is not to be limited to that of the above. More particularly, when the electric supply voltage of the recording area is 8 kV or more, a secondary function could be used as a voltage gradient instead of a linear function. On the other hand, the function used for voltage gradient could be selected in correspondence with the value of the electric supply voltage.

Although there are six electric supplying electrodes in the embodiment above, the number of the electric supplying electrode arc not to be limited, and further, the size or the arrangement of the intervals regarding the electric supplying electrode could differ to that of the embodiment above.

Although the resolution of the recording head is 600 dpi in the embodiment above, other resolution such as 1200 dpi could also be applied. Although the recording head for the embodiment above is of a full line type recording method, a serial type recording method where the recording head aligned in the conveying direction moves back and forth could also be used.

Third Embodiment

Figure 10:
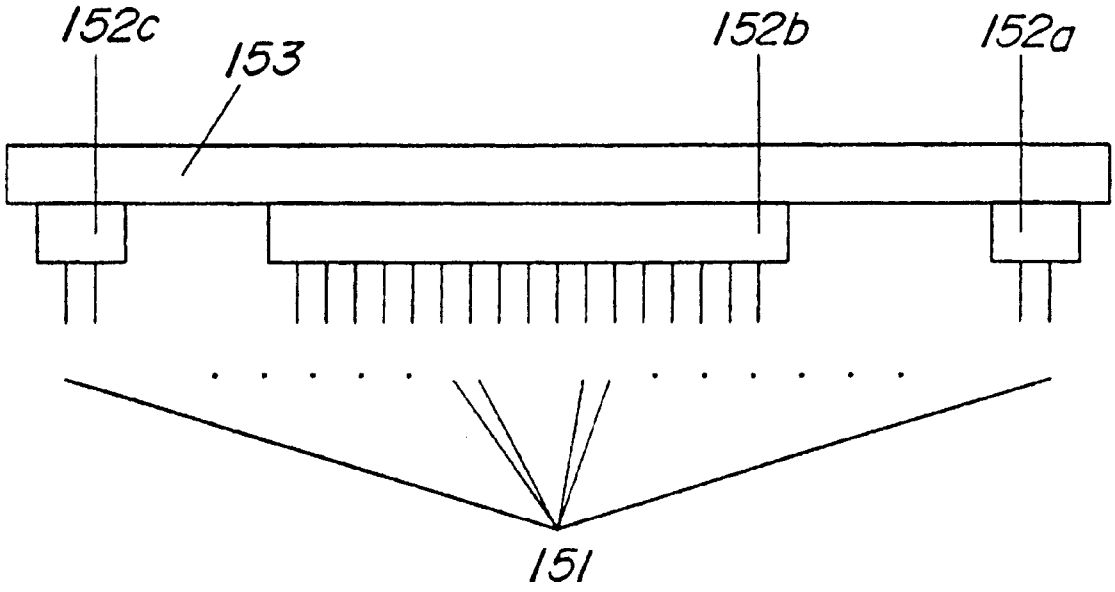
FIG. 10 is an explanatory view showing an attraction strength generating means regarding the third embodiment of this invention.

The third embodiment for this invention regarding a recording apparatus will be explained with reference to the drawings. FIG. 10 is an explanatory view showing an electric supplying means.

As shown in FIG. 10, the electric supplying means comprises: an electric supplying brush 151, a plurality of electric supplying electrodes 152*a* through 152*c*, a supporting member 153. Further, the electric supplying means has an electric supplying member being comprised of the electric supplying electrodes 152*a* through 152*c*, and the electric supplying brush 151 arranged to the electric supplying electrodes 152*a* through 152*c*, and being aligned in a conveying direction. The right side of FIG. 10 is the sheet feeding side, and the left side thereof is the sheet discharging side, in which a Sheet or a recording medium such as a recording sheet is conveyed from the right to the left. The electric supplying brush 151 contacts with a targeted electric supply portion (explained afterwards) of a conveyor belt 131 being a belt member, and supplies electric voltage upon the targeted electric supply portion of the conveyor belt 131.

In this embodiment, as shown in FIG. 10, the plural electric supplying electrodes have different length in the conveying direction, in which three electrodes are arranged. In this embodiment, the length for each of the electrodes in the conveying direction are as follows: the electrode 152*a* at the most upstream side and the electrode 152*c* at the most downstream side, both being a non-recording area, are respectively 3 cm; and the electrode 152*b* being a recording area is 20 cm. The intervals between each electrode 152*a*, 152*b*, 152*c* are 3 cm. Such size is a necessary requirement to prevent a single electric supplying brush from supplying electric voltage to a single targeted electric supply portion. The length of the targeted electric supply portion is 2 cm in the conveying direction.

Each electrode has a different electric potential, in which: the electric voltage for the electrode 152*a* is gradually boosted with a prescribed gradient, and changes from 0 kV (secondary voltage value) to 3.0 kV (primary voltage value); the electric voltage for the electrode 159*b* is 3.0 kV (primary voltage value); and the electric voltage for the electrode 152*c* is gradually lowered with a prescribed gradient, and changes from 3.0 kV (primary voltage value) to 0 kV (secondary voltage value). Accordingly, as the voltage gradually increases, the attraction of the conveyer belt 131 is gradually heightened, and then, after a steady attraction is created, the electric voltage gradually decreases and separation becomes easy.

Although in this embodiment, the primary voltage value for attracting the recording medium to the conveyer belt is 3.0 kV, and though, the secondary voltage value being lower than the primary voltage value 0 kV, this invention is not limited to such value.

Figure 17:
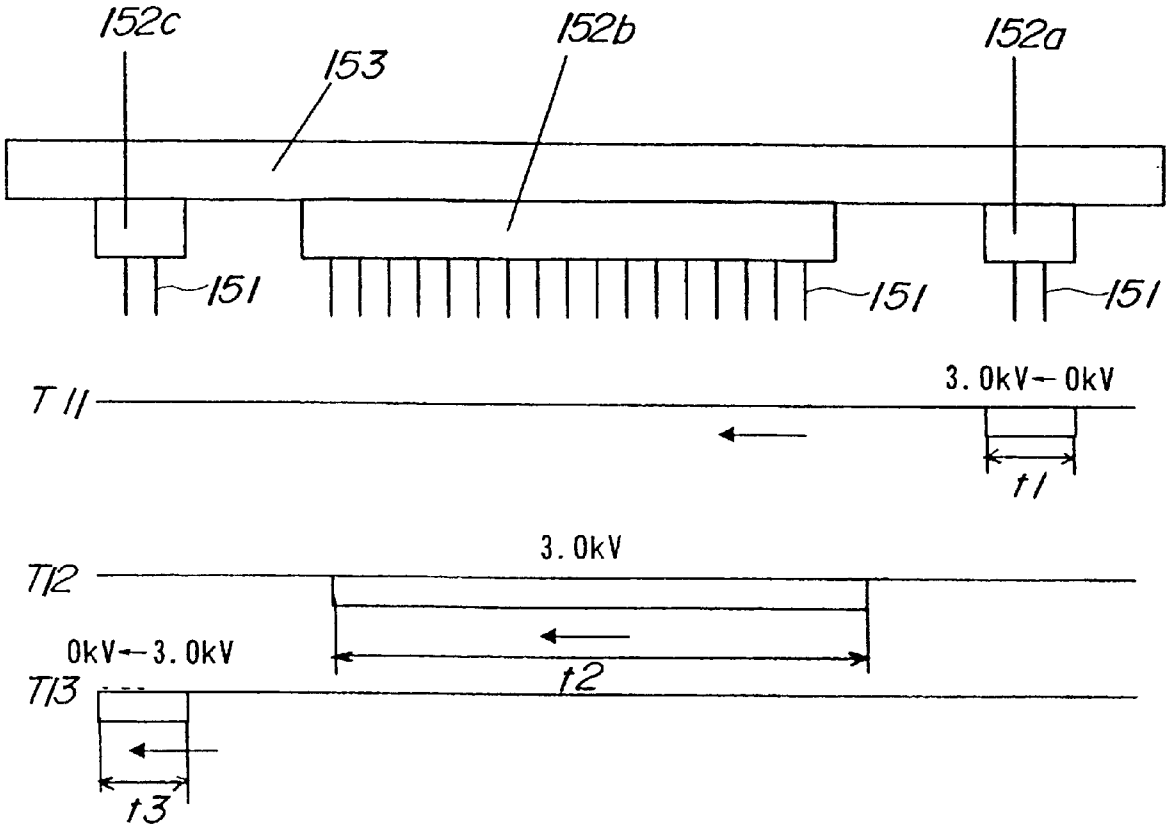
FIG. 17 is an explanatory view showing a state of electric supplying regarding the third embodiment of this invention.
Figure 18:
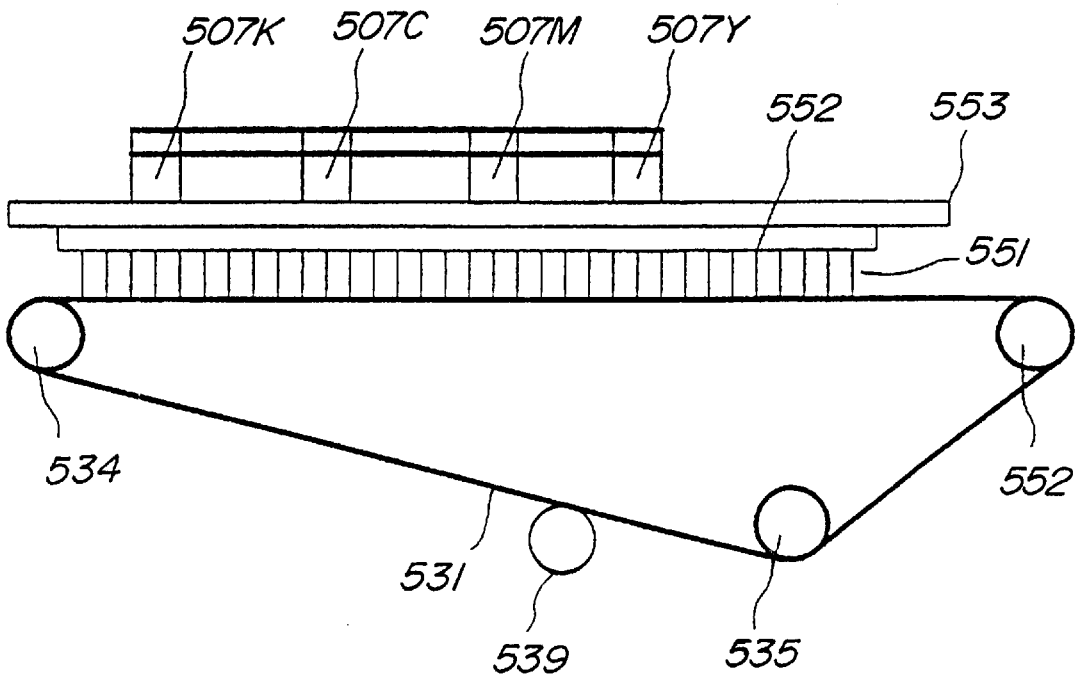
FIG.18 (Prior Art)
FIG. 18 is a schematic structural view of a conventional conveying device and recording apparatus.
Figure 19:
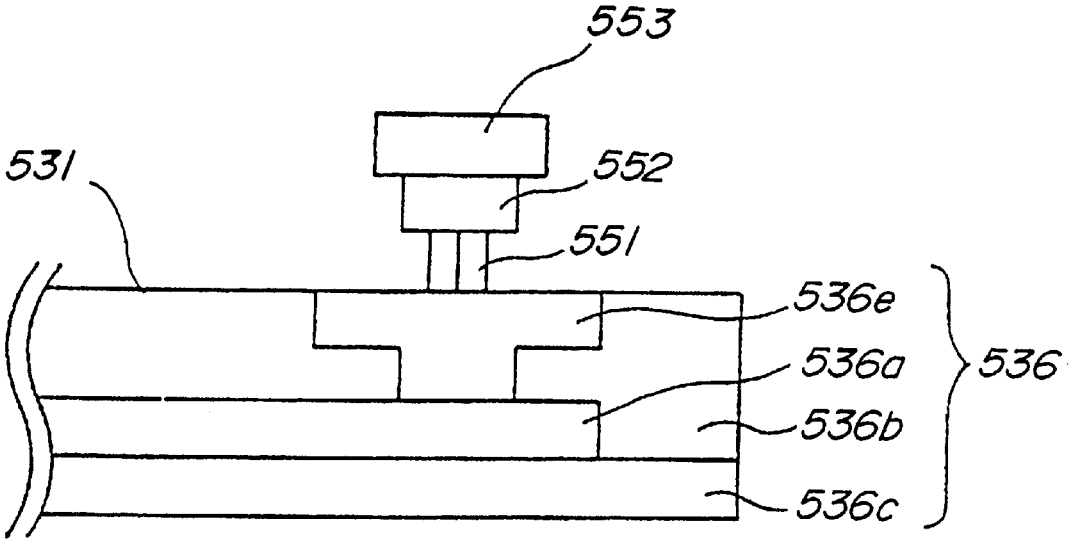
FIG.19 (Prior Art)
FIG. 19 is a schematic cross-sectional view of a conventional attraction means.

FIG. 17 shows a state of electric supply to a conveyer belt by the electric supplying means. In section t1 illustrated upon T11, the electric supplying brush 151 performs electric supply to allow the electric potential for electrode 152*a* to become from 0 kV to 3.0 kV. In a same manner, in section t2 illustrated upon T12, the electric supplying brush 151 performs electric supply to allow the electric potential for electrode 152*b* to become 3.0 kV; and in section t3 illustrated upon T13, the electric supplying brush 151 performs electric supply to allow the electric potential for electrode 152*c* to become from 3.0 kV to 0 kV. This sequence is performed repeatedly whenever contact is made upon an electrode plate 136. The timing for supplying the electric voltage is controlled by having a belt position detection means 181 (See FIG. 15) detect the positional relation between the electric supplying portion and the targeted electric supply portion. Such control is performed by a control system of this device (explained afterwards with reference to FIG. 15).

Figure 11:
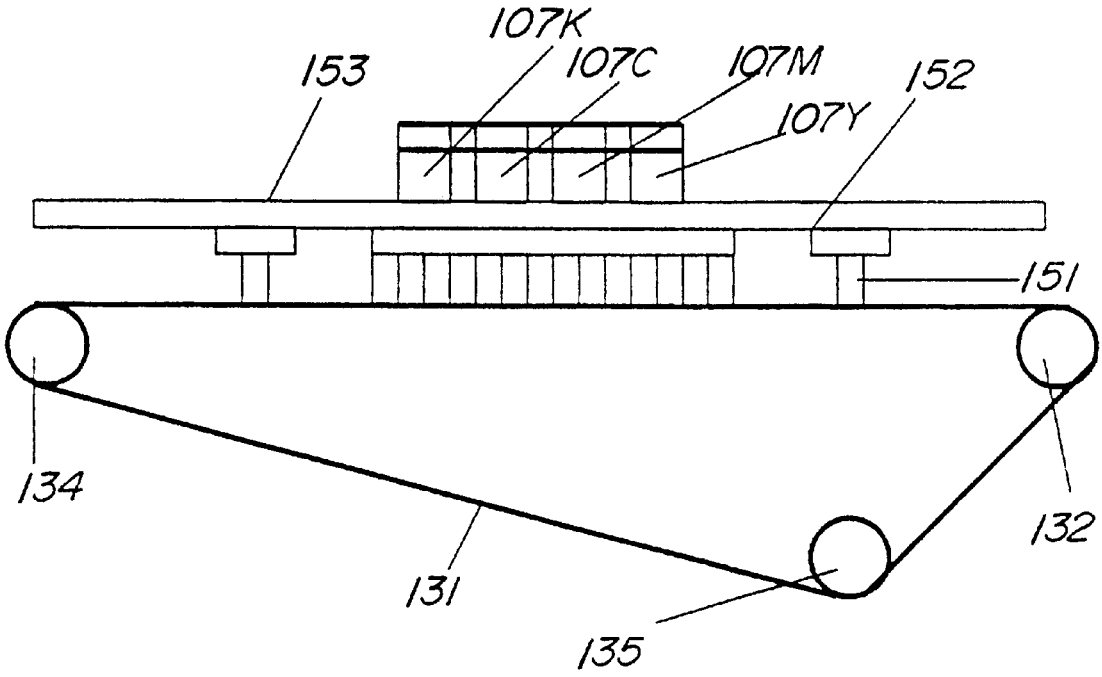
FIG. 11 is an explanatory view showing a positional relation between a conveyer belt and recording heads for the electric supplying means regarding the third embodiment of this invention.

The area of the centrally positioned electrode 52*b* is a point for recording and an area where strong attraction strength is desired, in which recording apparatuss (hereinafter also referred as "recording head") 107Y, 107M, 107C, 107K are arranged at thus area. FIG. 11 is an explanatory view showing a positional relation between a conveyer belt and recording heads for the electric supplying means. A recording medium conveyed on the conveyor belt 131 is attracted to the conveyor belt 131 by the electric voltage gradually increasing from 0 kV; and gradually the attraction would strengthen. At the position where the recording medium begins to pass the recording apparatus 107Y being arranged most upstream in the conveying direction, the recording medium is attracted with an electric voltage of 3.0 kV. The interval between each recording apparatus is a length of 3 cm, and the width of each recording apparatus is 2 cm in the conveying direction. The 20 cm length for the electric supplying electrode 52*b* of the recording area has a longer length than the length starting from a beginning position of the recording head 107Y being uppermost upstream till reaching the recording head 107K being lowermost downstream, and is a sufficient length for enabling electric supply to the conveyor belt of the recording area.

Figure 12:
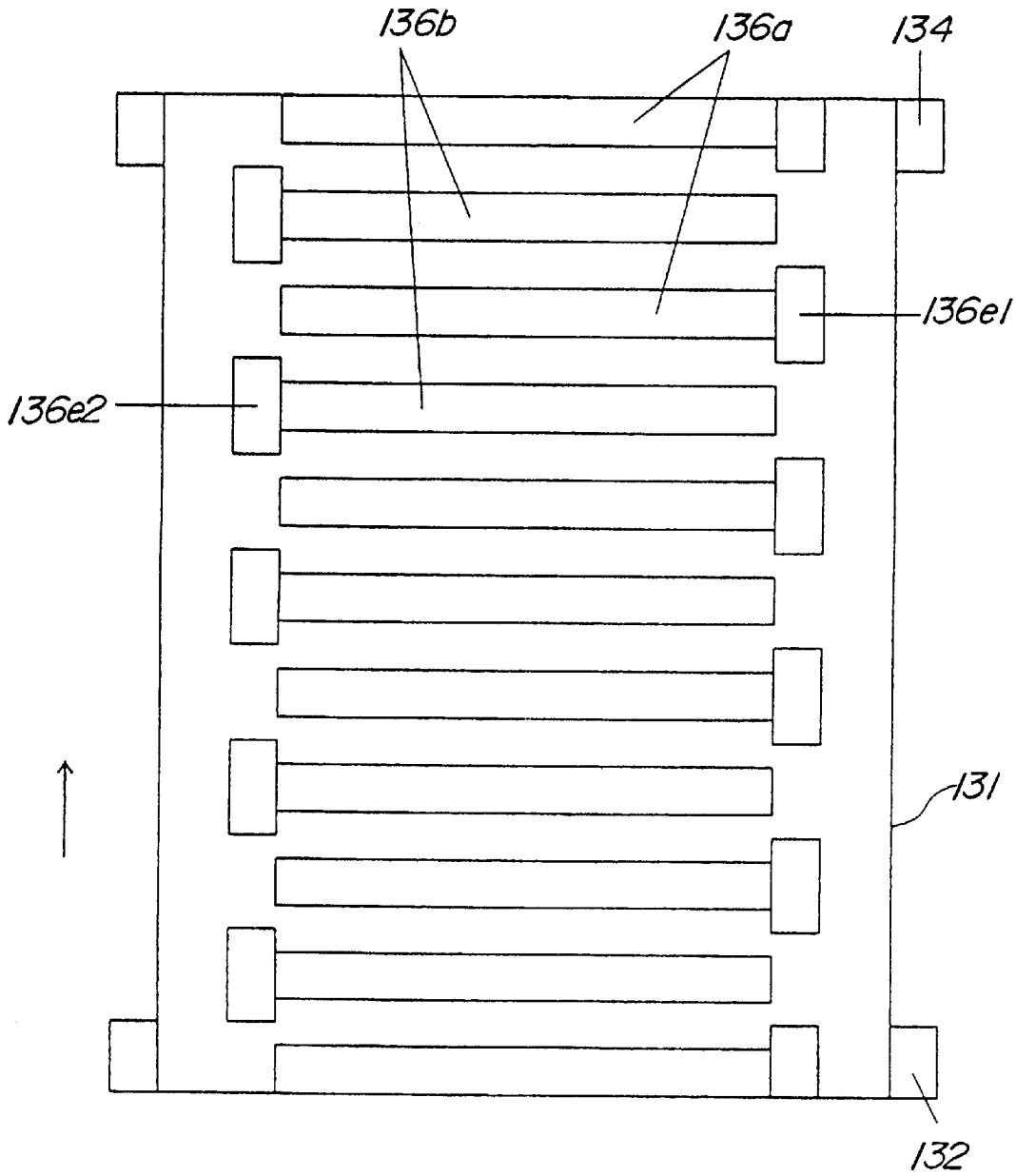
FIG. 12 is an explanatory view of a conveyer belt when looked upon from above regarding the third embodiment of this invention.

FIG. 12 is an explanatory view of a conveyer belt 131 and an attraction generating means 136 when looking upon the conveyer belt 131 from directly above the device body.

As shown in FIG. 12, the attraction generating means 136 of the conveyor belt 131 is structured with an electrode plate 136*a* and a grounding electrode plate 136*b*, in a manner resembling to the teeth of a comb as in the drawing. The electrode plate 136*a* and the grounding electrode plate 136*b* are plurally arranged in and out from a groove portion and a projecting portion, in a manner where the electrode plate 136*a* and the grounding electrode plate 136*b* are faced to each other in a direction perpendicularly intersecting to the belt conveying direction.

At both sides of the conveyor belt 131 in the conveying direction, the targeted electric supply portions 136*e*1, 136*c*2 are arranged having a longer length than the width of the respective electrodes 136*a*, 136*b*, and also arranged are a conductive electric supplying brush 151 contacting to each of the targeted electric supply portions 136*e*1, 136*e*2 with a prescribed pressure.

Owing to the electric supplying brush 151, positive electric voltage is supplied from a high voltage power source (not shown) to the targeted electric supply portion 136*e*1. The targeted electric supply portion 136*e*2 is dropped to a grounding. It is preferable to comprise the electric supplying brush 151 by using a conductive material with a volume resistivity of $10^{-4}$ through $10^{-5}$ ΩM.

Figure 16:
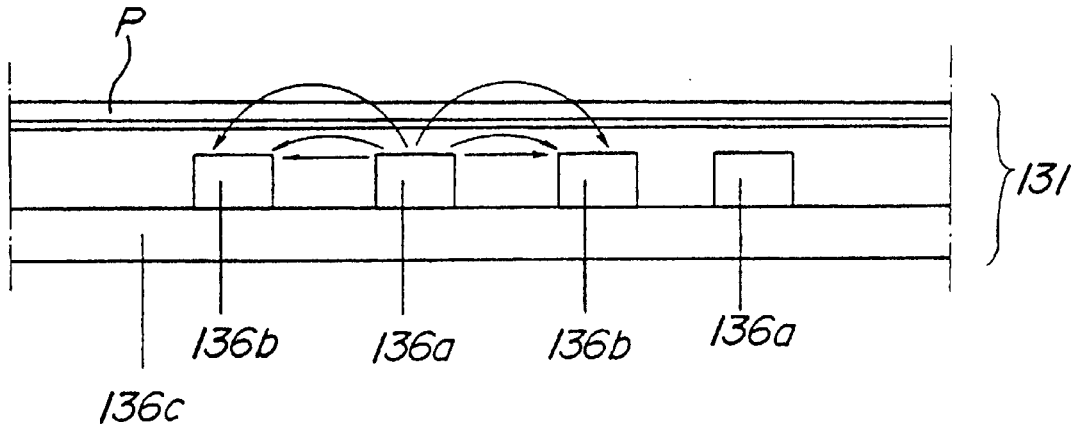
FIG. 16 is an explanatory view for showing a generation of attraction strength of an attraction strength generating means regarding the third embodiment of this invention.

FIG. 16 is an explanatory view for showing a generation of attraction strength of an attraction strength generating means. As shown in FIG. 16, when electric voltage is applied to the electrode plate 136*a*, electric power is generated in an arrow direction Shown in FIG. 16 and an electric power line is formed. Subsequently, owing to an electric potential difference between the electrode plate 136*a* and the grounding electrode plate 136*b*, attraction strength is generated above the conveyor belt 131 and a recording medium P on the conveyor belt 131 is attracted.

In respect of this invention, since a base layer is structured to have a greater volume resistivity than a surface layer, the generated electric power line would be greater on a top surface of the belt for enabling attraction strength to become larger.

Figure 13:
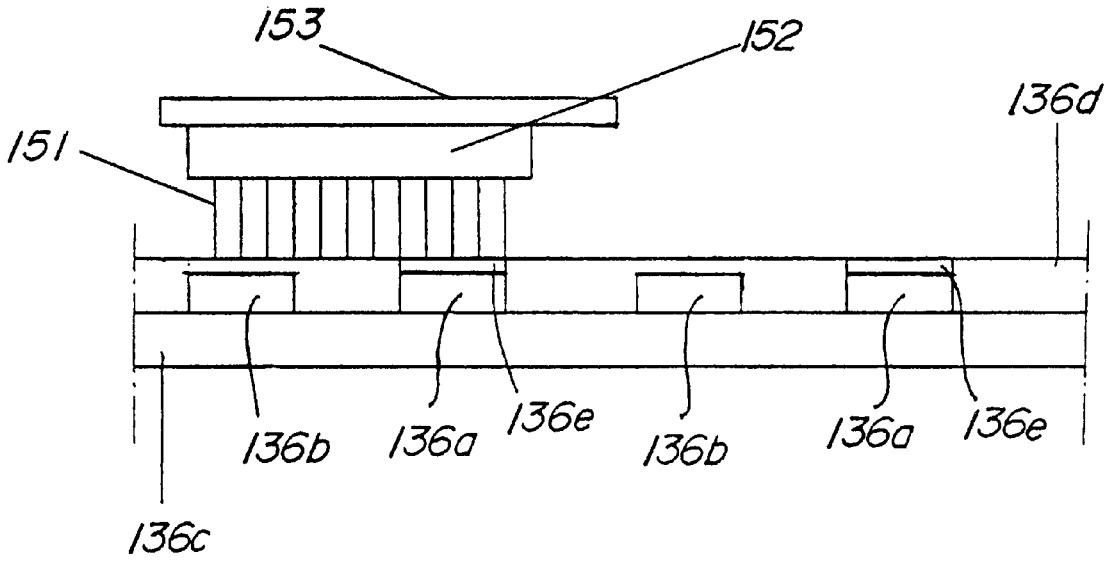
FIG. 13 is an explanatory view showing electric supplying of an electric supplying means to a conveyor belt regarding the third embodiment of this invention.

FIG. 13 is an explanatory view showing electric supplying of an electric supplying means to a conveyor belt. As shown in FIG. 13, an attraction strength generating means 136 is comprised of an electrode plate 136*a* made from a conductive metal, a grounding electrode plate 136*b*, a base layer 136*c*, a surface layer 136*d*, and a targeted electric supply portion 136*e*, in which the attraction strength generating means 136 is formed as a united body with the conveyor belt 131. As explained above, the electric supplying means is comprised of the electric supplying brush 151, the electric supplying electrode 152, and supporting member 153. The targeted electric supply portion 136*e* and the surface layer 136*d* are arranged on the same plane. The electric supplying brush 151 contacts with the targeted electric supply portion 136*e* and supplies electric voltage thereto.

The electrode plate 136*a* and the grounding electrode plate 136*b* are protected by being sandwiched by the base layer 136*c* and the surface layer 136*d* being made from dielectric material.

The volume resistivity for the base layer 136*c* is $10^{15}$ through $10^{17}$ Ωm and the volume resistivity for the surface layer 136*d* is $10^{10}$ through $10^{14}$ Ωm, in which both are comprised of synthetic material such as polyethylene or polycarbonate PVdF.

The electrode plate 136*a* and the grounding electrode plate 136*b* are protected by being sandwiched by the base layer 136*c* and the surface layer 136*d* being made from dielectric material.

The targeted electric supply portion 136*e* is comprised from a conductive synthetic resin with carbon inside having a volume resistivity of $10^{-4}$ through $10^{-1}$ Ωm.

The top Surface of the surface layer 136*d* and the targeted electric supply portion 136*e* are processed by means such as fluorine resin processing so as to create satisfactory water-repellency.

Figure 14:
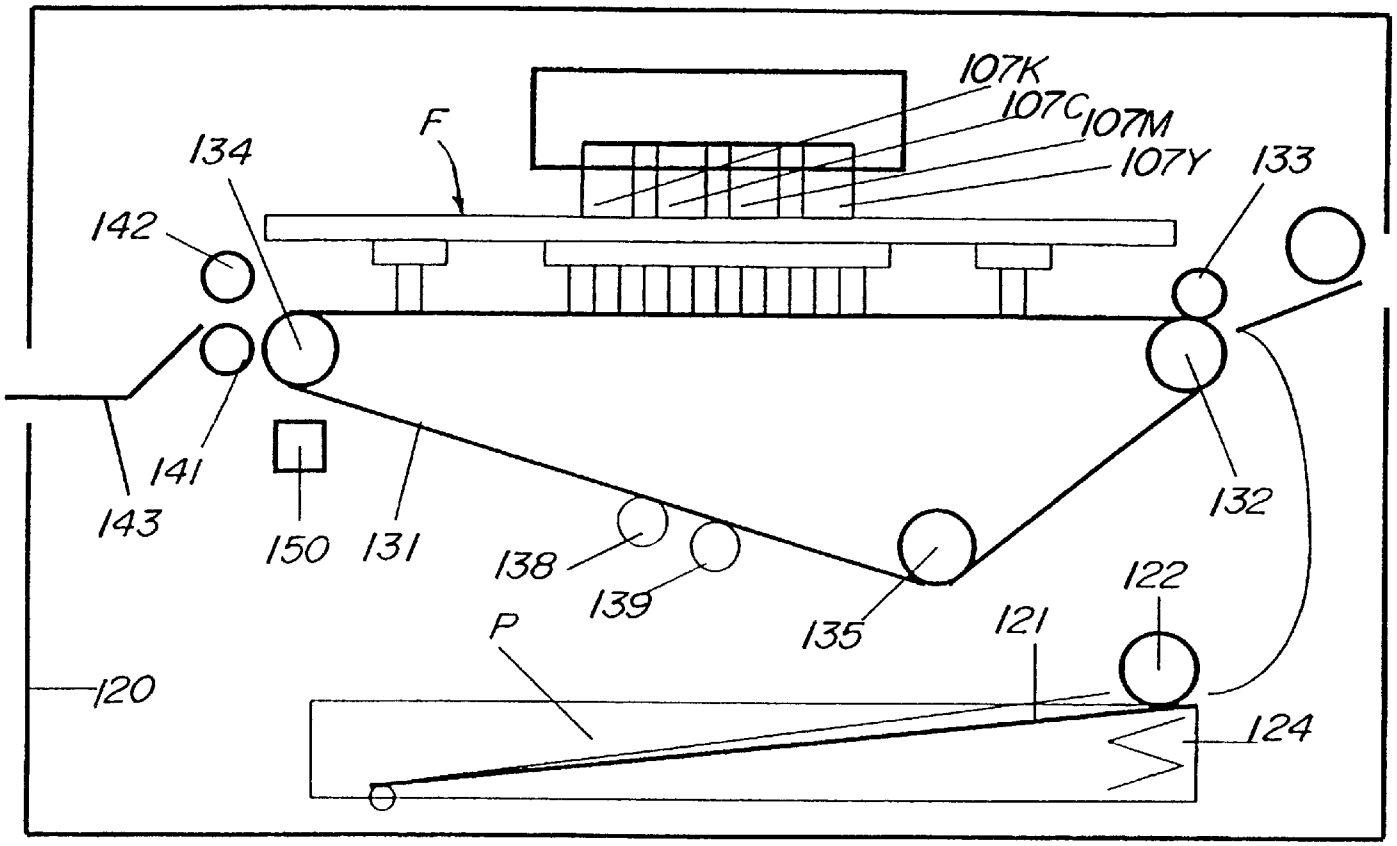
FIG. 14 is a cross-sectional view showing an entire structure of a recording apparatus regarding the third embodiment of this invention.

Next, an entire structure regarding a recording apparatus for this invention will be described with reference to FIG. 14. A sheet feeding portion, a conveying portion, a recording head portion serving as a recording head, and a sheet discharging portion comprising the recording apparatus will be described in detail.

Regarding the sheet feeding portion, a pressure plate 121 for loading a recording medium P, and a rotating feeding member 122 for feeding the recording medium P are rotatively arranged with a rotation axis serving as a center, in which the rotation axis is combined to a base 120, and the pressure plate 21 is urged upon the rotating feeding member 122 by a pressure plate spring 124.

The pressure plate 121 has a separation pad (not shown) made from a material having a large friction coefficient for preventing doubly feeding of the recording medium P, and a separation claw for separating the recording medium P. Further, a release cam (not shown) for releasing the contact between the pressure plate 121 and the rotating feeding member 122.

Thus structured, the pressure plate 121 is pressed downward by the release cam when in a waiting state. Accordingly, the contact between the pressure plate 121 and the rotating feeding member 122 is released.

In such state, when a driving force of the conveying roller 132 is transmitted by a gear or the like to the rotating feeding member 122 and the release cam, the release cam is separated from the pressure plate 121, and the pressure plate 121 rises so that the rotating feeding member 122 and the recording medium P would make contact; subsequently, in accordance with the rotation of the rotating feeding member 122, the recording medium P is picked up to begin sheet feeding. The rotating feeding member 122 continues to rotate until the recording sheet is delivered to the conveying portion.

The conveying portion has a conveyor belt 131 being a belt member for attracting and conveying the recording medium P, and a PE sensor (not shown).

The conveyor belt 131 is driven by a driving roller 134, and is wrapped around a conveying roller 132 serving as subordinately moving roller, and around a pressure roller 135. A belt motor 150 serves as a driving source for the driving roller 134. The conveyor belt 131 is made from a synthetic resin such as polyethylene, and has a non-end belt shape.

The symbol F is an electric supplying means. The electric supplying means F will hereinafter be described in detail.

The electric supplying means F supplies electric voltage of approximately 0 kV to 10 kV to allow the recording medium to attach closely to the conveyor belt 131 (publicly known technology is used in terms for a high voltage generating means and a high voltage controlling means).

The conveyor belt 131 moves at a speed of 170 mm per second when set in a normal recording mode. The distance between each of the conveyed recording mediums (hereinafter referred as "sheet between distance") is 10 cm when an A4 sized paper is used under a normal recording mode. When the recording medium is of an A3 size, the sheet between distance is 15 cm.

A pinch roller 133 subordinately moving with the conveyor belt 131 is arranged at a position facing and contacting to the conveying roller 132. The recording heads 107K, 107C, 107M and 107Y serving as the recording apparatus are arranged downstream of the conveying roller 132 in the conveying direction. The resolution of the recording heads is 600 dpi. The recording heads are of a full line inkjet type having several discharge ports arranged in a direction perpendicularly intersecting to the conveying direction.

The recording heads are capable of applying heat upon ink by a beater or the like. The ink is film boiled from such heat, and a growth or shrinkage of an air bubble created from the film boiling causes change in pressure so that ink could be discharged from a nozzle to form an image upon the recording medium P.

The sheet discharging portion has a sheet discharging roller 141 and a spur 142, in which the recording medium P having an image formed thereupon is sandwiched between the sheet discharging roller 141 and the spur 142, and is conveyed to and discharged from a sheet discharge tray 143. It is now to be noted that the spur has a small area contacting to the recording medium, and is structured to prevent disarranging of the recorded image of the recording medium even when contacting the recorded surface.

Numeral 138 is a cleaning roller for cleaning the conveyor belt 131. Numeral 139 is an electric removal brush for making sheet discharging easy by grounding electric charge remaining on the conveyor belt 131.

Figure 15:
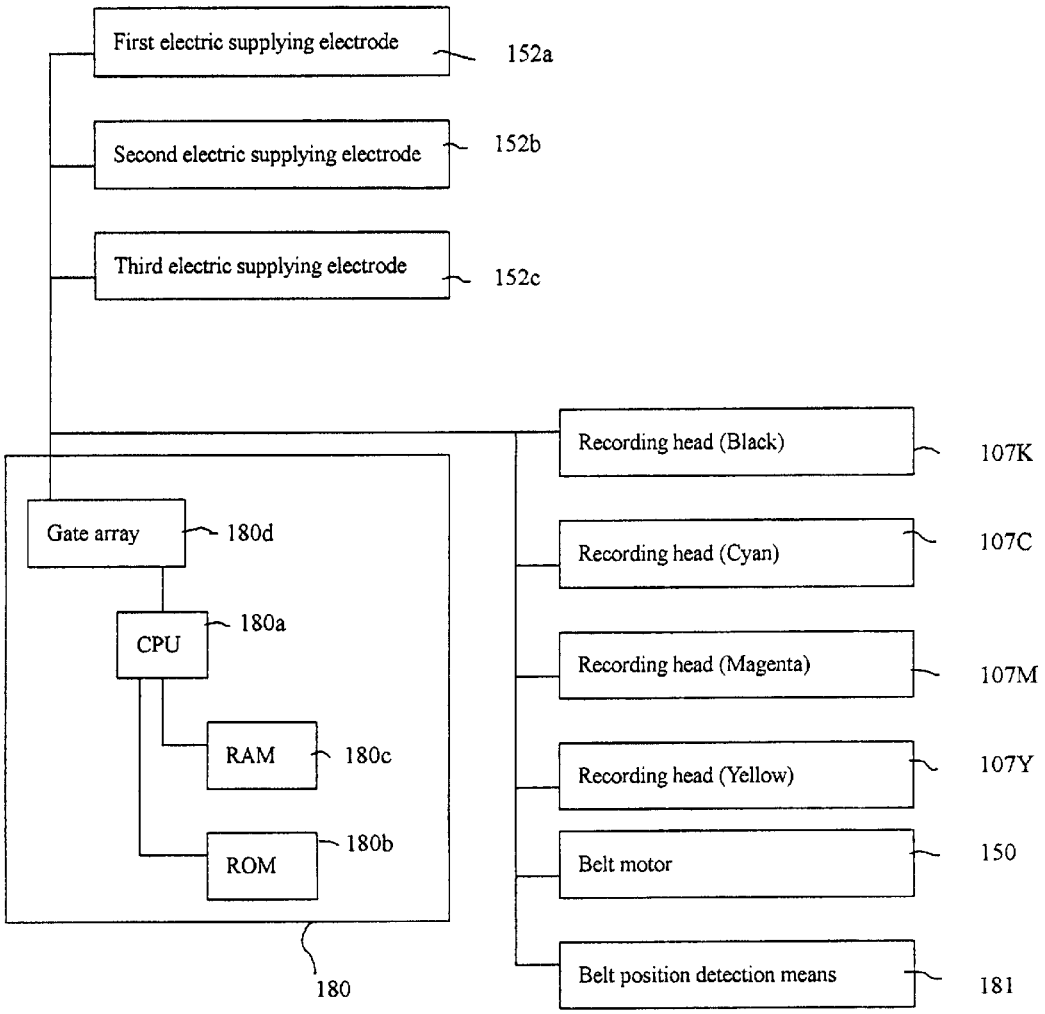
FIG. 15 is a block diagram of a control for a recording apparatus regarding the third embodiment of this invention.

FIG. 15 is a block diagram of a control for a recording apparatus regarding this invention. In FIG. 15, numeral 180 is a control section serving as a control means, which comprises a CPU 180*a* functioning in accordance with a control program, a ROM 180*b* being the memory for storing the control program, and a RAM 180*c* serving as the memory for operation and serving to save stain detection data. Along with the CPU 180*a*, a gate array 180*d* is an LSI serving to control a signal for the recording head or a signal for the electric supplying electrode.

The control section 180 serving as a control means is connected to the following. Numeral 150 is a belt motor serving as a driving force for rotating the conveyor belt 131. Numeral 181 is a belt position detection means 181 for detecting positional relation between the electric supply portion and the targeted electric supply portion. Numeral 107K is a recording head for black, numeral 107C is a recording head for cyan, numeral 107M is a recording head for magenta, and numeral 107Y is a recording head for yellow. Numeral 152*a* is the first electric supplying electrode, numeral 152*b* is the second electric supplying electrode, and numeral 152*c* is the third electric supplying electrode.

As described above, regarding the electric supplying means having plural electric supplying members aligned in the conveying direction, after the electric supplying brush 151 for the electric supply electrode 152 being arranged at a non-recording area upstream of the recording area has made contact to the targeted electric supply portion of the conveyor belt 131, in means to allow attraction of the recording medium to the conveyor belt, an electric voltage is gradually raised starting from the secondary electronic supply value (0 kV) being smaller than the primary electronic value (3.0 kv) and is raised to the primary electric value (3.0 kV) until separating from the targeted electric supply portion; accordingly, compared to a case where high voltage is applied at once, the shock during contact could be reduced. Therefore, the endurance for electric supplying member could be heightened.

Further, regarding the foregoing electric supplying means, after the electric supplying brush 151 for the electric supply electrode 152 being arranged at a non-recording area downstream of the recording area has made contact to the targeted electric supply portion of the conveyor belt 131, in means to allow attraction of the recording medium to the conveyor belt 131, an electric voltage is gradually lowered starting from the primary electronic supply value (3 kV) and is lowered to the secondary electric value (0 kv) being lower than the primary electric value (3.0 kV) until separating from the targeted electric supply portion; accordingly, compared to a case where electricity is short circuited at once, the shock during the removing of electricity could be reduced. Therefore, the endurance for electric supplying member could be heightened.

Accordingly, the noise caused by the conveyor belt could be exceedingly reduced to allow the device to operate steadily.

Further, the creation of ozone or the like caused by electric discharge could be reduced to lowered the effect upon the environment.

Although each electric potential of the electrodes regarding the foregoing embodiment are different, in which the electric voltage of the electrode 152*a* positioned upstream of the recording area in the conveying direction changes from 0 kV to 3.0 kV, the electric voltage of the electrode 152*b* is 3.0 kV, and the electric voltage of the electrode 152*c* positioned downstream of the recording area in the conveying direction changes from 3.0 kV to 0 kV, other electric voltage values could be applied for this invention and should not be limited to that of the above. In other words, each of the foregoing values could be set to gradually heighten an attraction strength of the conveyor belt before reaching the recording area, to obtain steady attraction strength at the recording area, and to gradually lower an attraction strength of the conveyor belt after passing for easy separation.

As for the type of inkjet recording apparatus, there are image output terminal of a information processing utility such as a computer, or an inkjet input-output device attached with carriage having a scanner or something other than a recording head, a copy machine combined with a reader or the like, or further, a fax machine having a sending-receiving function.

Although a recording type of an inkjet type is used in this embodiment, a thermal transfer recording type, heat sensitive recording type, or an impact recording type such as a wire-dot recording type, or other electro photographic types of recording types could be used and should not be limited to the inkjet type.

As described above, according to this embodiment, the electric supplying means having plural electric supplying members aligned in the conveying direction serves to reduce shock during contact compared to a case of suddenly applying high voltage so as to heighten the endurance for an electric supplying member, in which an electric supplying member at a non-recording area positioned upstream of a recording area gradually raises electric voltage from a secondary electric voltage value being smaller than that of the primary electric voltage value for allowing a sheet to be attracted upon a belt member after making contact with a targeted electric supply portion of the belt member, and the electric voltage is raised to the primary electric voltage value until being separated from the targeted electric supply portion.

Further, the foregoing electric supplying means serves to reduce shock during removal of electricity compared to the shock of short-circuiting suddenly and results to heighten the endurance for an electric supplying member, in which an electric supplying member at a non-recording area positioned downstream of a recording area gradually lowers electric voltage from a primary electric voltage value for allowing a recording medium to be attracted upon a belt member after making contact with a targeted electric supply portion of the belt member, and the electric voltage is lowered to the secondary electric voltage value being smaller than the primary electric voltage value until being separated from the targeted electric supply portion.

Accordingly, the noise caused by the conveyor belt could be exceedingly reduced to allow the device to operate steadily.

Further, the creation of ozone or the like caused by electric discharge could be reduced to lowered the effect upon the environment.

What is claimed is:

1. A sheet conveying device for attracting a sheet by electric power and for conveying the sheet, the sheet conveying device comprising:

a belt arranged with an electrode; and a plurality of electric supplying means being aligned in a sheet conveying direction for supplying electric voltage to the electrode, wherein an electric voltage value for an electric supplying means arranged at a primary area upstream in a sheet conveying direction is lower than an electric voltage value for an electric supplying means arranged at a secondary area downstream of the primary area in a sheet conveying direction, and wherein the primary area is an area located at the electric supplying means at an end of the series of plural electric supplying means aligned in the sheet conveying direction.

2. A sheet conveying device for attracting a sheet by electric power and for conveying the sheet, the sheet conveying device comprising:

a belt arranged with an electrode; and a plurality of electric supplying means being aligned in a sheet conveying direction for supplying electric voltage to the electrode, wherein an electric supply control means is provided for changing an electric voltage value of the plurality of electric supplying means, wherein the electric supply control means has a plurality of absorption modes being predetermined with a combination regarding each electric voltage value of the plurality of electric supplying means, the electric supply control means changes each electric voltage value for the plurality of electric supplying means by selecting the absorption mode, and wherein the electric voltage value for an electric supplying means arranged at a primary area in a sheet conveying direction is lower than an electric voltage value for an electric supplying means arranged at a secondary area downstream in a sheet conveying direction.

3. The sheet conveying device as claimed in any one of claim 1 and claim 2, wherein each electric voltage value for the plurality of electric supplying means becomes set with a higher value or a same value the more closer headed from upstream to downstream.

4. A recording apparatus for recording an image upon a sheet comprising:

a belt arranged with an electrode; and a plurality of electric supplying means being aligned in a sheet conveying direction for supplying electric voltage to the electrode, wherein an electric voltage value for an electric supplying means arranged at a primary area upstream in a sheet conveying direction is lower than an electric voltage value for an electric supplying means arranged at a secondary area downstream of the primary area in a sheet conveying direction, and wherein the primary area is an area located at the electric supplying means at an end of the series of plural electric supplying means aligned in the sheet conveying direction; and a recording head mounting means for mounting a recording head for recording an image upon a sheet conveyed by the belt.

5. A recording apparatus for recording an image upon a sheet comprising:

the sheet conveying device as claimed in any one of claim 1 through claim 2, and a recording head mounting means for mounting the recording head for recording an image upon a sheet conveyed by the sheet conveying device, wherein the secondary area is an area where an image is recorded upon a sheet by the recording head, and wherein the electric voltage value of an electric supplying means arranged at such area is higher than the electric voltage value of other electric supplying means.

6. The recording apparatus according to claim 5, wherein the primary area is positioned upstream of the area where an image is recorded upon a sheet by the recording head, and wherein each electric voltage value for the plurality of electric supplying means arranged at such area becomes set with a higher value or a same value the more closer headed from upstream to downstream.

7. A recording apparatus for recording an image upon a sheet, and including a sheet conveying device, the recording apparatus comprising:

a belt arranged with an electrode; and a plurality of electric supplying means being aligned in a sheet conveying direction for supplying electric voltage to the electrode, wherein an electric supply control means is provided for changing an electric voltage value of the plurality of electric supplying means, wherein the electric supply control means has a plurality of absorption modes being predetermined with a combination regarding each electric voltage value of the plurality of electric supplying means, the electric supply control means changes each electric voltage value for the plurality of electric supplying means by selecting the absorption mode, and wherein the electric voltage value for an electric supplying means arranged at a primary area in a sheet conveying direction is lower than an electric voltage value for an electric supplying means arranged at a secondary area downstream in a sheet conveying direction; and a recording head mounting means for mounting the recording head for recording an image upon a sheet conveyed by the belt.

8. The recording apparatus according to claim 7, wherein the secondary area is an area where an image is recorded upon a sheet by the recording head.

9. The recording apparatus according to claim 7, wherein the primary area is positioned upstream of the area where an image is recorded upon a sheet by the recording head.

10. A sheet conveying device supplying electric voltage to a belt member while rotating the belt member, and conveying a sheet by attracting the sheet to a surface of the belt member, the sheet conveying device comprising:

an electric supplying means being capable of supplying electric voltage to a belt member having a targeted electric supply portion, and having a plurality of electric supplying members aligned in a conveying direction; and a control means for controlling the electric voltage value of electric voltage supplied from the plurality of electric supplying members of the electric supplying means to the targeted electric supply portion of the belt member, wherein an electric supplying member of the electric supplying means being most upstream in a conveying direction gradually raises the electric voltage from a secondary electric voltage value being smaller than a primary electric voltage value for allowing attraction of a sheet upon the belt member after making contact to a targeted electric supply portion of the belt member, and raises the electric voltage to the primary electric voltage value until separated from the targeted electric supply portion.

11. A sheet conveying device supplying electric voltage to a belt member while rotating the belt member, and conveying a sheet by attracting the sheet to a surface of the belt member, the sheet conveying device comprising:

an electric supplying means being capable of supplying electric voltage to a belt member having a targeted electric supply portion, and having a plurality of electric supplying members aligned in a conveying direction; and a control means for controlling the electric voltage value of electric voltage supplied from the plurality of electric supplying members of the electric supplying means to the targeted electric supply portion of the belt member, wherein the electric supplying means has an electric supplying member being most downstream in a conveying direction, which gradually lowers the electric voltage from a primary electric voltage value for allowing attraction of a sheet upon the belt member after making contact to a targeted electric supply portion of the belt member, and lowers the electric voltage to a secondary electric voltage value being smaller than the primary electric voltage value until separated from the targeted electric supply portion.

12. The sheet conveying device according to claim 10 or claim 11, wherein each electric supply value for each electric supplying member of the electric supplying means at a most upstream side and at a most downstream side in a conveying direction has a prescribed gradient.

13. A recording apparatus comprising:

the sheet conveying device as claimed in any one of either claim 10 or claim 11; and a recording head mounting means for mounting the recording head for recording an image upon a sheet conveyed by the belt member.

14. A recording apparatus supplying electric voltage to a belt member and attracting a recording medium to a surface of the belt member while rotating the belt member, and recording upon a recording medium being attracted and conveyed by the belt member with a recording means, the recording means comprising:

an electric supplying means being capable of supplying electric voltage to a belt member having a targeted electric supply portion, and having a plurality of electric supplying members aligned in a conveying direction; and a control means for controlling the electric voltage value of electric voltages supplied from the plurality of electric supplying members of the electric supplying means to the targeted electric supply portion of the belt member, wherein an electric supplying member of a non-recording area being more upstream than a recording area of the recording means in a conveying direction gradually raises the electric voltage from a secondary electric voltage value being smaller than a primary electric voltage value for allowing attraction of a sheet upon the belt member after making contact to a targeted electric supply portion of the belt member, and raises the electric voltage to the primary electric voltage value until separated from the targeted electric supply portion, and wherein an electric supplying member of a non-recording area being more downstream than a recording area of the recording means in a conveying direction gradually lowers the electric voltage from a primary electric voltage value for allowing attraction of a sheet upon the belt member after making contact to a targeted electric supply portion of the belt member, and lowers the electric voltage to a secondary electric voltage value being smaller than the primary electric voltage value until separated from the targeted electric supply portion.

15. The recording apparatus according to claim 14, wherein each electric supply value for each electric supplying member of a non-recording area regarding the electric supplying means has a prescribed gradient.

16. The recording apparatus according to claim 14 or claim 15, wherein the recording apparatus has a belt position detection means for detecting a positional relation between the electric supplying means and the targeted electric supply portion, and wherein the belt position detection means detects a positional relation between the electric supplying means and the targeted electric supply portion for enabling control of the timing for supplying the electric voltage.

17. The recording apparatus as claimed in claim 14, wherein the recording head is of an inkjet type.

18. The recording apparatus as claimed in claim 7, wherein the recording head is of an inkjet type.

19. The recording apparatus as claimed in claim 13, wherein the recording head is of an inkjet type.

20. A recording apparatus for recording an image upon a sheet comprising:

a belt arranged with an electrode; and a plurality of electric supplying means being aligned in a sheet conveying direction for supplying electric voltage to the electrode, wherein an electric supply control means is provided for changing an electric voltage value of the plurality of electric supplying means, wherein the electric supply control means has a plurality of absorption modes being predetermined with a combination regarding each electric voltage value of the plurality of electric supplying means, the electric supply control means changes each electric voltage value for the plurality of electric supplying means by selecting the absorption mode, and wherein the electric voltage value for an electric supplying means arranged at a primary area in a sheet conveying direction is lower than an electric voltage value for an electric supplying means arranged at a secondary area downstream in a sheet conveying direction; and a recording head mounting means for mounting a recording head for recording an image upon a sheet conveyed by the belt.

21. A recording apparatus for recording an image upon a sheet, the recording apparatus comprising:

a belt arranged with an electrode; and a plurality of electric supplying means being aligned in a sheet conveying direction for supplying electric voltage to the electrode, wherein an electric supply control means is provided for changing an electric voltage value of the plurality of electric supplying means, wherein the electric supply control means has a plurality of absorption modes being predetermined with a combination regarding each electric voltage value of the plurality of electric supplying means, the electric supply control means changes each electric voltage value for the plurality of electric supplying means by selecting the absorption mode, and wherein the electric voltage value for an electric supplying means arranged at a primary area in a sheet conveying direction is lower than an electric voltage value for an electric supplying means arranged at a secondary area downstream in a sheet conveying direction; and a recording head mounting means for mounting the recording head for recording an image upon a sheet conveyed by the belt.

* * * * *

UNITED STATES PATENT AND TRADEMARK OFFICE

CERTIFICATE OF CORRECTION

PATENT NO. : 6,595,515 B2
DATED : July 22, 2003
INVENTOR(S) : Yasuhiro Numata et al.

It is certified that error appears in the above-identified patent and that said Letters Patent is hereby corrected as shown below:

Column 1,
Line 30, “state.” should read -- state.
An electric supplying means is comprised of an electric supplying brush 551, an electrode 552, and a supporting member 553. --

Column 3,
Line 19, “bolt” should read -- belt --.

Column 5,
Line 35, “ail” should read -- an --.

Column 6,
Line 39, “to” should be deleted.

Column 7,
Line 33, “Surface” should read -- surface --.
Line 38, “thus” should read -- this --.
Line 49, “. Combined” should read -- combined --.

Column 9,
Line 15, “same to ” should read -- the same as --.
Line 17, “would” should read -- will --.
Lines 30, 37, 52 and 61, “are” should read -- is --.
Line 64, “F or” should read -- for --.

Column 10,
Line 38, “electrode” should read -- electrodes --; and “arc” should read -- are --.

Column 11,
Line 5, “length” should read -- lengths --.
Line 8, “are” should read -- is --.
Line 22, “159b” should read -- 152b --.
Line 58, “apparatuss” should read -- apparatus --.
Line 60, “at thus” should read -- in this --.

Column 12,
Lines 19 and 30, “to” should be deleted.
Line 29, “are” should read -- is --.

UNITED STATES PATENT AND TRADEMARK OFFICE

CERTIFICATE OF CORRECTION

PATENT NO. : 6,595,515 B2
DATED : July 22, 2003
INVENTOR(S) : Yasuhiro Numata et al.

It is certified that error appears in the above-identified patent and that said Letters Patent is hereby corrected as shown below:

Column 15,
Lines 12 and 27, “electronic” should read -- electric --.
Line 14, “tronic” should read -- tric --.
Line 42, “are” should read -- is --.
Line 57, “a” should read -- an --.

Signed and Sealed this

Ninth Day of March, 2004

JON W. DUDAS
*Acting Director of the United States Patent and Trademark Office*